US011685622B2

(12) United States Patent
Niwa et al.

(10) Patent No.: US 11,685,622 B2
(45) Date of Patent: Jun. 27, 2023

(54) MEDIUM FEEDING DEVICE AND MEDIUM PROCESSING APPARATUS INCLUDING THE SAME

(71) Applicant: FUJIFILM BUSINESS INNOVATION CORP., Tokyo (JP)

(72) Inventors: Masahito Niwa, Kanagawa (JP); Yuichi Araki, Kanagawa (JP); Shoichi Maeda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 194 days.

(21) Appl. No.: 17/141,802

(22) Filed: Jan. 5, 2021

(65) Prior Publication Data

US 2022/0081239 A1 Mar. 17, 2022

(30) Foreign Application Priority Data

Sep. 13, 2020 (JP) ..... 2020-153402

(51) Int. Cl.
*B65H 7/14* (2006.01)
*B65H 3/48* (2006.01)
(Continued)

(52) U.S. Cl.
CPC ..... *B65H 5/062* (2013.01); *B65H 3/48* (2013.01); *B65H 5/222* (2013.01); *B65H 7/08* (2013.01);
(Continued)

(58) Field of Classification Search
CPC .. B65H 3/48; B65H 3/0816; B65H 2511/514; B65H 2301/44724; B65H 2511/524; B65H 7/06; B65H 7/14
See application file for complete search history.

(56) References Cited

U.S. PATENT DOCUMENTS 7,748,320 B2 * 7/2010 Ikeda ..... B65H 3/48 271/97
8,827,266 B2 * 9/2014 Umi ..... G03G 15/70 271/263
(Continued)

FOREIGN PATENT DOCUMENTS

JP 2016-653 A 1/2016

*Primary Examiner* — Patrick Cicchino
(74) *Attorney, Agent, or Firm* — Oliff PLC

(57) ABSTRACT

A medium feeding device includes a storage unit that stores media in a form of a sheet, a delivery unit that is disposed downstream in a medium delivery direction relative to the media stored in the storage unit and that delivers the media individually, a transfer unit that is disposed above the storage unit and that sticks by suction to each of the media stored in the storage unit and transfers the media to the delivery unit individually, and a fluffing unit that is disposed beside the media stored in the storage unit in a direction intersecting the medium delivery direction. The fluffing unit fluffs an upper-side region of the media in a state of being separated by blowing air toward a side of the media. The medium feeding device further includes plural position detection units that are arranged in a region that is on the delivery unit side relative to a position of a downstream end portion, in the medium delivery direction, of each of the media stored in the storage unit and that does not reach a contact portion where the delivery unit comes into contact with the media. The position detection units are arranged at an interval in a width direction of the media intersecting the medium delivery direction. The position detection units detect a position of the downstream end portion, in the medium delivery direction, of each of the media.

19 Claims, 21 Drawing Sheets

(51) Int. Cl.
*B65H 7/08* (2006.01)
*B65H 5/06* (2006.01)
*B65H 5/22* (2006.01)

(52) U.S. Cl.
CPC ..... *B65H 7/14* (2013.01); *B65H 2301/44724* (2013.01); *B65H 2511/24* (2013.01); *B65H 2511/514* (2013.01); *B65H 2801/06* (2013.01)

(56) References Cited

U.S. PATENT DOCUMENTS

| | | | | |
|---|---|---|---|---|
| 9,039,010 | B2 * | 5/2015 | Umi | H04N 1/00663 271/265.01 |
| 9,359,157 | B2 | 6/2016 | Niikura et al. | |
| 10,507,994 | B2 * | 12/2019 | Sendo | B65H 5/222 |
| 11,059,687 | B2 * | 7/2021 | Sakamoto | B65H 1/08 |

* cited by examiner

MEDIUM FEEDING DEVICE AND MEDIUM PROCESSING APPARATUS INCLUDING THE SAME

CROSS-REFERENCE TO RELATED APPLICATIONS

This application is based on and claims priority under 35 USC 119 from Japanese Patent Application No. 2020-153402 filed Sep. 13, 2020.

BACKGROUND

(i) Technical Field

The present disclosure relates to a medium feeding device and a medium processing apparatus including the medium feeding device.

(ii) Related Art

Japanese Unexamined Patent Application Publication No. 2016-653 (refer to DETAILED DESCRIPTION OF THE PREFERRED EMBODIMENTS and FIG. 17) discloses a sheet feeding device including a constituent that enables long sheets to be placed on a sheet feeding tray by a tray bottom plate of the sheet feeding tray being extended. In the sheet feeding device, sheets are fluffed by blowing air from a side of the sheet feeding tray, and a transport belt sticks by suction to a fluffed sheet and delivers the sheet.

SUMMARY

Aspects of non-limiting embodiments of the present disclosure relate to, in a medium feeding device including a transfer unit and a fluffing unit, addressing a technical challenge to preventing a medium from becoming stuck (jamming) during medium feeding.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a medium feeding device including a storage unit that stores media in a form of a sheet, a delivery unit that is disposed downstream in a medium delivery direction relative to the media stored in the storage unit and that delivers the media individually, a transfer unit that is disposed above the storage unit and that sticks by suction to each of the media stored in the storage unit and transfers the media to the delivery unit individually, and a fluffing unit that is disposed beside the media stored in the storage unit in a direction intersecting the medium delivery direction. The fluffing unit fluffs an upper-side region of the media in a state of being separated by blowing air toward a side of the media. The medium feeding device further includes plural position detection units that are arranged in a region that is on the delivery unit side relative to a position of a downstream end portion, in the medium delivery direction, of each of the media stored in the storage unit and that does not reach a contact portion where the delivery unit comes into contact with the media. The position detection units are arranged at an interval in a width direction of the media intersecting the medium delivery direction. The position detection units detect a position of the downstream end portion, in the medium delivery direction, of each of the media.

BRIEF DESCRIPTION OF THE DRAWINGS

Exemplary embodiments of the present disclosure will be described in detail based on the following figures, wherein.

DETAILED DESCRIPTION

Outline of Exemplary Embodiments

Figure 1A:
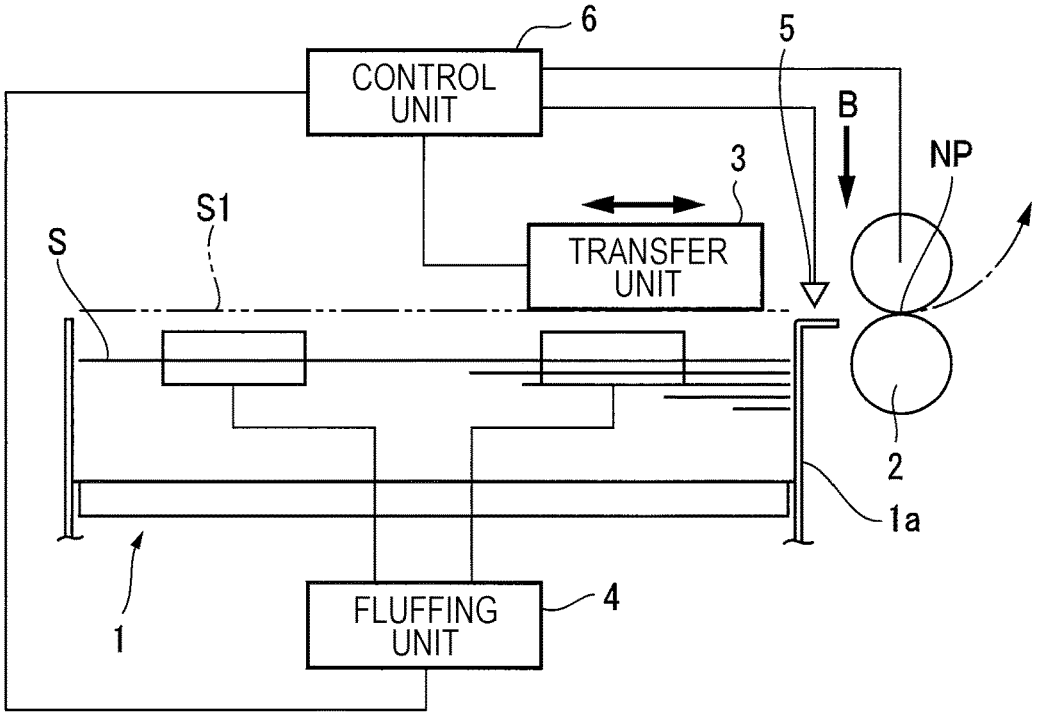
FIG. 1A illustrates schematically a medium feeding device according to an exemplary embodiment of the present disclosure.
Figure 1B:
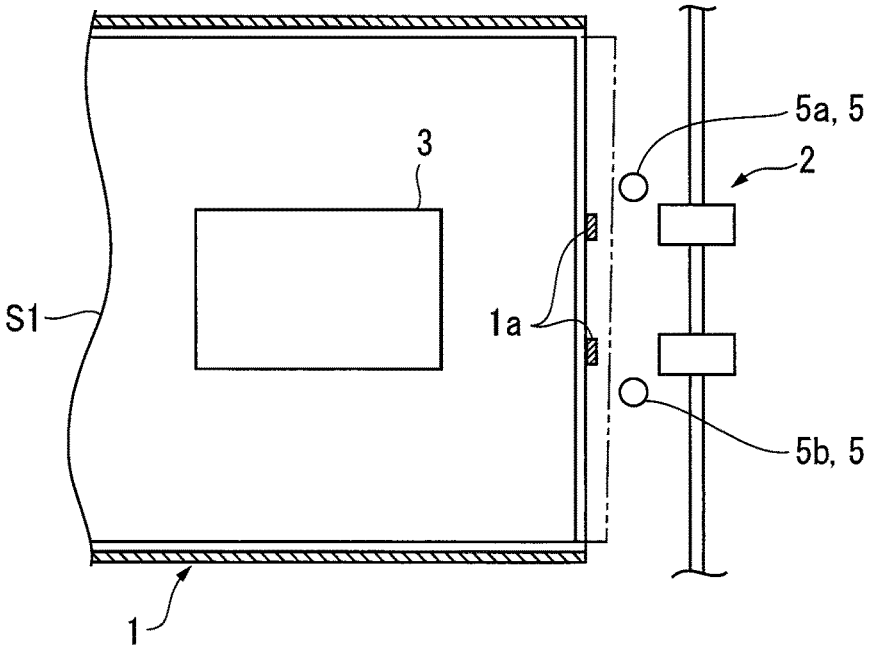
FIG. 1B illustrates the medium feeding device in FIG. 1A as viewed in direction B.

FIGS. 1A and 1B illustrate schematically a medium feeding device according to an exemplary embodiment of the present disclosure.

The medium feeding device illustrated in FIGS. 1A and 1B feeds media S in a form of a sheet individually. Other than a case of being used alone, the medium feeding device is implemented in a form of a medium processing apparatus by being used, for example, in combination with a processing unit (not illustrated in FIGS. 1A and 1B) that performs predetermined processing on the media S that have been fed. The processing unit here may be any unit such as an image forming unit that forms an image on a medium or a coating unit that performs coating on a medium.

In the present exemplary embodiment, as FIGS. 1A and 1B illustrate, the medium feeding device includes a storage unit 1 that stores media S in a form of a sheet, a delivery unit 2 that is disposed downstream in a medium delivery direction relative to the media S stored in the storage unit 1 and that delivers the media S individually, a transfer unit 3 that is disposed above the storage unit 1 and that sticks by suction to each of the media S stored in the storage unit 1 and transfers the media S to the delivery unit 2 individually, and a fluffing unit 4 that is disposed beside the media S stored in the storage unit 1 in a direction intersecting the medium delivery direction. The fluffing unit 4 fluffs an upper-side region of the media S in a state of being separated by blowing air toward a side of the media S. The medium feeding device further includes plural position detection units 5 that are arranged in a region that is on the delivery unit 2 side relative to a position of a downstream end portion, in the medium delivery direction, of each of the media S stored in the storage unit 1 and that does not reach a contact portion NP where the delivery unit 2 comes into contact with the media S. The position detection units 5 are arranged at an interval in a width direction of the media S intersecting the medium delivery direction. The position detection units 5 detect a position of the downstream end portion, in the medium delivery direction, of each of the media S.

In particular, a representative example of the medium feeding device further includes a control unit 6 that determines whether a state of a downstream end portion, in the medium delivery direction, of a medium S1 is within a predetermined permissible range, based on information detected by the position detection units 5, and that stops a feeding operation of the medium S1 when the state of the downstream end portion of the medium S1 in the medium delivery direction is in an abnormal range that is out of the permissible range.

In such a technical configuration, the storage unit 1 typically has a stacking portion on which media S are to be stacked. A type that stores media S of a variety of sizes has, at a position beside the media S in a direction intersecting the delivery direction of the media S, a side guide portion that guides media S for positioning the media S, or the type has, at a rear position upstream in the delivery direction of media S, a rear guide portion that guides the media S for positioning the media S. The storage unit 1 is often withdrawable with respect to a housing of the medium feeding device in view of media S supplement capability. In this example, jamming of media S while being caught by the delivery unit 2 is suppressed from occurring, and the storage unit 1 is thereby able to be withdrawn smoothly.

The delivery unit 2 may be any delivery unit having a function of delivering media S. For example, paired delivery rollers and a combination of a delivery roller and a delivery belt are representative, and, in both cases, a "medium S1-contact-portion NP" means a nip region between such delivery members that nip a medium S1, which is to be delivered, therebetween. For example, when the delivery unit 2 is a pair of rollers, the medium S1-contact-portion NP is a region (nip region) in which the paired rollers are in contact with one another. Alternatively, one of the paired rollers may transport a belt, and the rollers may hold the belt therebetween.

This example is based on the premise that the transfer unit 3 and the fluffing unit 4 are mounted and may be any of various types such as a large medium-storage-capacity type or a long-sheet-capable type. In particular, any type having a storage unit 1 that is able to be withdrawn may be used.

Regarding the position detection units 5, it is possible to select position detection units appropriately as long as plural position detection units may be arranged at an interval in the width direction intersecting the delivery direction of the media S. The position detection units 5 here are for grasping a skew state of the downstream end portion, in the delivery direction, of media S, and at least two (5*a* and 5*b*) may thus be provided. However, note that three or more position detection units may also be arranged. An image sensor that extends continuously in the width direction of the media S is unlikely to be used as the position detection unit 5 in view of interference with the transfer unit 3.

Next, a representative example or other examples of the present exemplary embodiment will be described.

The position detection units 5, as an example, are arranged closer to the downstream end portion, in the delivery direction, of the media S that are stored in the storage unit 1, than to the contact portion NP of the delivery unit 2 with the media. In this example, because a distance between a medium that has been detected and the contact portion of the delivery unit 2 with the medium is long, when the position detection units 5 detect a state of a downstream end portion, in the delivery direction, of the medium, the medium is prevented from reaching the contact portion of the delivery unit during detection of a delivery state of the medium.

Regarding the position detection units 5, as an example, the storage unit 1 further has, on the delivery unit 2 side, a stopper wall 1*a* that is capable of retaining the media S stored in the storage unit 1 when the fluffing unit is not used, and the position detection units 5 are arranged closer to the medium S1-contact-portion NP of the delivery unit 2 than to the stopper wall 1*a*. In this example, it is possible to select arrangement locations of the position detection units 5 relative to the stopper wall 1*a*.

The position detection units 5, as an example, are attached to respective attachment portions that are provided in portions of a holding frame of the delivery unit 2. In this example, when the position detection units 5 are arranged near the delivery unit 2, an attachment structure of the position detection units 5 is simplified by using the holding frame of the delivery unit 2.

The position detection units 5, as an example, are arranged, in the width direction of the medium S1, on the outer sides of the media S1-contact-portion NP of the delivery unit 2 in close proximity to the media S1-contact-portion NP. When the position detection units 5 are arranged at an interval in the width direction of the medium S1, it is difficult to arrange the position detection units 5 on the inner side of the medium S1-contact-portion NP of the delivery unit 2 in the width direction of the medium S1 due to a concern about interference with the transfer unit 3. Thus, this example is a possible arrangement example in view of setting an interval as short as possible in the width direction.

A representative example of the control unit 6 grasps a skew state of the downstream end portion, in the delivery direction, of the medium S1 based on information received from the position detection units 5 and determines whether the skew state is within a permissible range. In this example, in a case in which a medium S1 to be delivered is skewed to a large extent, when, for example, the medium S1 that has been delivered is subjected to predetermined processing by the processing unit, there is a concern that such processing on a correct region of the medium S1 fails to be performed, and this example is thus for avoiding such an event in advance. The permissible range and the abnormal range with respect to the skew state of the medium S1 may be set appropriately for a model of each medium processing apparatus in consideration of the processing quality of a processing unit.

Based on this representative example, the control unit 6, as an example, also addresses a case in which the position detection units 5 do not detect the presence of a medium S1 within a predetermined time period as a case included in the abnormal range. This example is on the assumption that a medium S1 is caught by, for example, the stopper wall 1*a* of the storage unit 1.

The control unit 6, as an example, provides a notification to an alert unit that issues an alert to a user, when the control unit 6 determines that a state of a downstream end portion, in the delivery direction, of a medium S1 is in the abnormal range. Receiving such an alert, the user is able to check an abnormality of the medium S1 that is fed from the storage unit 1.

The control unit 6, as an example, returns a medium S1 to the original position with the transfer unit 3 sticking to the medium S1 by suction and stops a transfer operation when, following a determination that a state of the downstream end portion, in the delivery direction, of the medium S1 is in the abnormal range, a feeding operation of the medium S1 is stopped with the downstream end portion, in the delivery direction, of the medium S1 not being in contact with the delivery unit 2. In this example, even if an abnormality occurs in feeding the medium S1, in a condition in which the medium S1 has not reached the position of the medium S1-contact-portion NP of the delivery unit 2, an abnormal medium S1 is returned to the original position in the storage unit 1 when the feeding operation of the medium S1 is stopped. Thus, this example may prevent the abnormal medium S1 from being left as is.

The control unit 6, as an example, causes the delivery unit 2 to stop after the delivery operation by the delivery unit 2 has been completed, when, following a determination that a state of a downstream end portion, in the delivery direction, of a medium S1 is in the abnormal range, the feeding operation of the medium S1 is stopped with the downstream end portion, in the delivery direction, of the medium S1 being in contact with the delivery unit 2. In this example, whether the medium S1 is in contact with the delivery unit may be determined by using another position detection unit, which is not illustrated, disposed downstream immediately beside the delivery unit 2. This example is on the assumption that the downstream end portion, in the delivery direction, of the medium S1 has already passed through the delivery unit 2 although an abnormality of the medium S1 is determined, and, if the feeding operation of the medium S1 is stopped in such a condition, the medium S1 is left while being in contact with the delivery unit 2. Thus, in this example, the delivery operation of the medium S1 is to be completed by the delivery unit 2 so that there is no involvement of the medium S1 in the delivery unit 2.

Hereinafter, exemplary embodiments of the present disclosure will be described with reference to the accompanying drawings.

First Exemplary Embodiment

Figure 2:
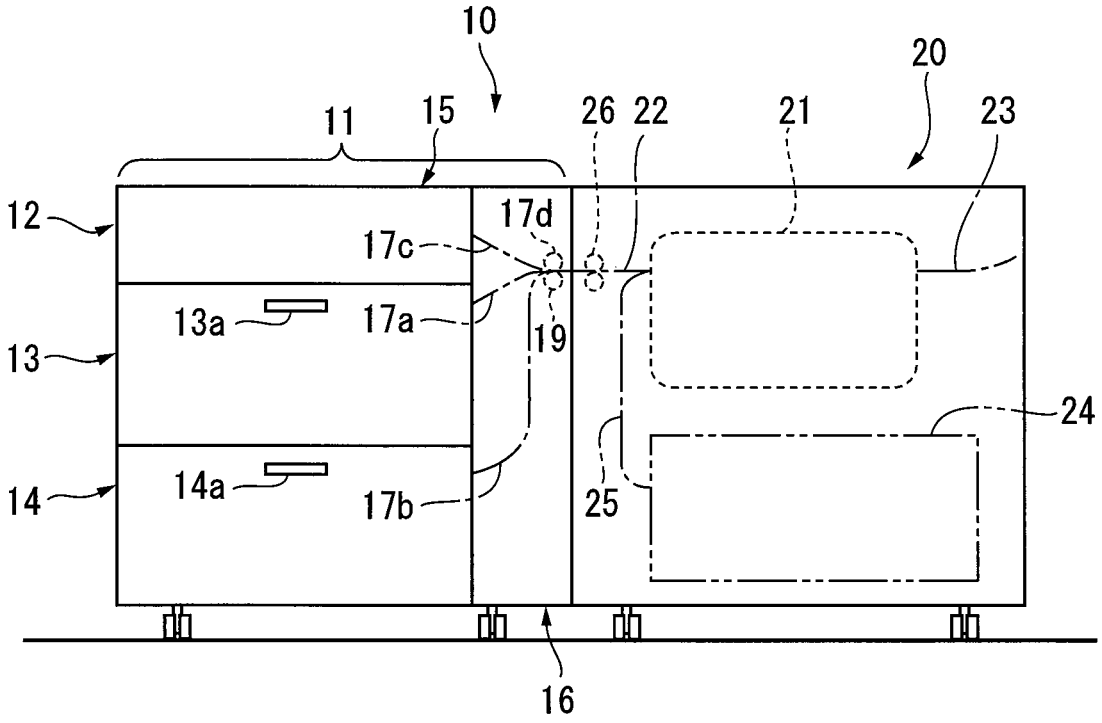
FIG. 2 illustrates the overall configuration of a medium processing apparatus according to a first exemplary embodiment.

FIG. 2 illustrates the overall configuration of a medium processing apparatus according to a first exemplary embodiment.

Overall Configuration of Medium Processing Apparatus

In FIG. 2, a medium processing apparatus 10 includes a medium feeding device 11 that feeds media in a form of a sheet individually and a processing unit 20 as a processing unit that performs predetermined processing on the media that have been fed from the medium feeding device 11.

In this example, the processing unit 20 includes an image forming portion 21 that forms images on the media. The image forming portion 21 may adopt various image forming systems such as an electrophotographic system or an ink-jet recording system. The processing unit 20 includes an inbound transport path 22 used to transport the media that are fed from the medium feeding device 11 into the image forming portion 21 and an outbound transport path 23 used to transport the media on which images have been formed by the image forming portion 21 out of the processing unit 20. In this example, a built-in medium feeding portion 24 is further separately provided below the image forming portion 21 in the processing unit 20, and media that are fed from the medium feeding portion 24 are also fed into the image forming portion 21 via a feeding transport path 25. Reference 26 denotes an inbound transport roller 26 disposed at the entrance of the inbound transport path 22, and the appropriate number of transport members are provided in the inbound transport path 22, the outbound transport path 23, and the feeding transport path 25.

Overall Configuration of Medium Feeding Device

Figure 3:
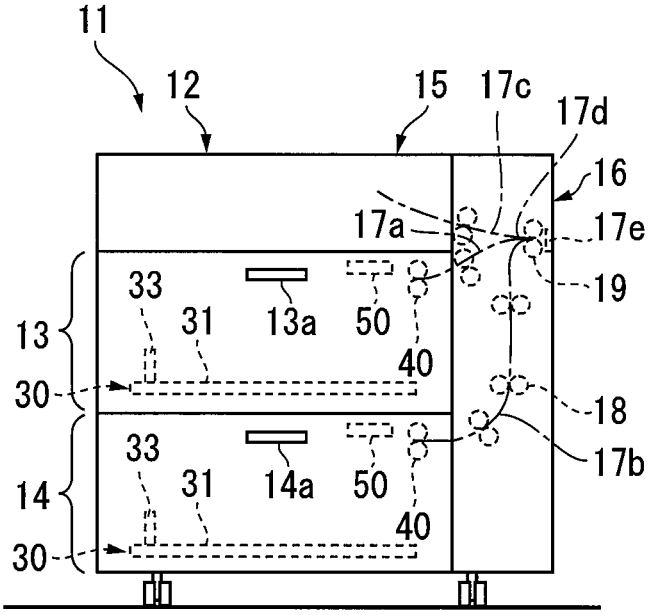
FIG. 3 illustrates an example of a medium feeding device used for the medium processing apparatus according to the first exemplary embodiment.

In this example, as FIGS. 2 and 3 illustrate, the medium feeding device 11 has a housing 12 that stores media, and, in the housing 12, an upper drawer 13 and a lower drawer 14 that are two-layer drawer-type drawers are provided so as to be withdrawn. In addition, a manual feeding portion 15 by which media are enabled to be fed manually is disposed in an upper portion of the housing 12. On the processing unit 20 side of the housing 12, a relay unit 16 that relays and transports media that are fed from the upper drawer 13, the lower drawer 14, and the manual feeding portion 15 to the processing unit 20 side is provided.

In this example, both the upper drawer 13 and the lower drawer 14 store a large amount of media and feed the media individually. The relay unit 16 includes a first outbound transport path 17*a* used to transport outward the media that are fed from the upper drawer 13, a second outbound transport path 17*b* used to transport outward the media that are fed from the lower drawer 14, and a third outbound transport path 17*c* used to transport outward the media that are fed from the manual feeding portion 15. The first to third outbound transport paths 17*a* to 17*c* have the appropriate number of transport rollers 18, and a merging transport path 17*d* that is connected to an outlet 17*e* to the processing unit 20 is formed on the exit side of each of the first to third outbound transport paths 17*a* to 17*c*. The merging transport path 17*d* includes a discharging roller 19. The upper drawer 13 and the lower drawer 14 have handles 13*a* and 14*a*, respectively, and are capable of being withdrawn frontward.

Configuration Example of Upper Drawer (Lower Drawer)

In this example, the upper drawer 13 and the lower drawer 14 have configurations substantially similar to one another. Hereinafter, the drawers will be described by referring to an example of the upper drawer 13.

Figure 4:
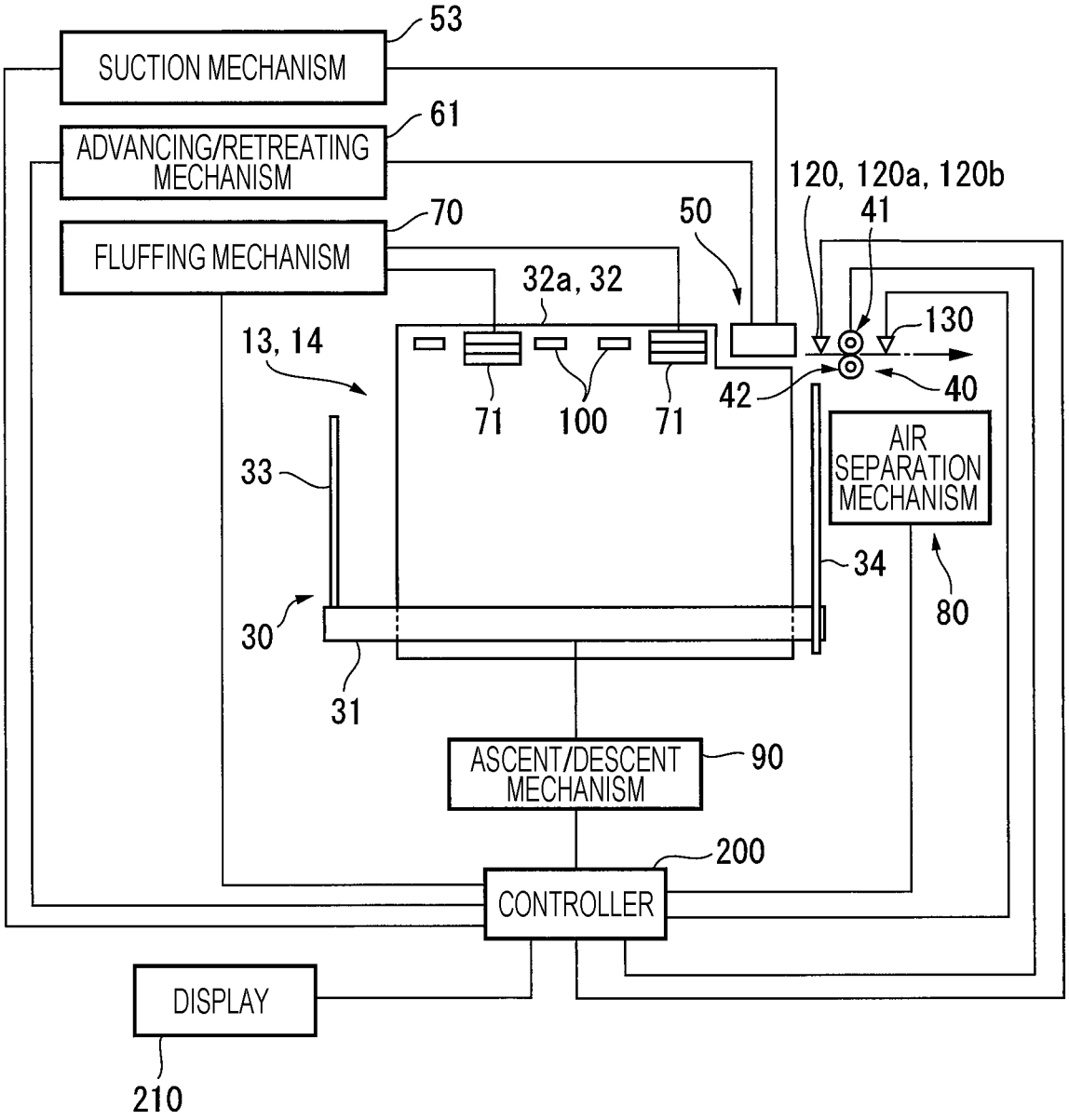
FIG. 4 illustrates a control system of the medium feeding device according to the first exemplary embodiment.

In this example, for example, as FIG. 4 illustrates, the upper drawer 13 has a storage portion 30 as a storage unit that stores media as a form of a sheet, a delivery roller 40 as a delivery unit that is disposed downstream in the medium delivery direction relative to the media stored in the storage portion 30 and that delivers the media individually, a vacuum head 50 as a transfer unit that is disposed above the storage portion 30 and that sticks by suction to each of the media stored in the storage portion 30 and transfers the media to the delivery roller 40 individually, a fluffing mechanism 70 as a fluffing unit that is disposed beside the media stored in the storage portion 30 in a direction intersecting the medium delivery direction. The fluffing mechanism 70 fluffs an upper-side region of the media in a state of being separated by blowing air toward a side of the media. The upper drawer 13 further has an air separation mechanism 80 that is provided, in the media delivery direction, downstream of the media that are stored in the storage portion 30 and that blows air toward a region between an upper-side medium that has been fluffed by the fluffing mechanism 70 and a medium below the upper-side medium to cause the fluffed medium to be separated from the other media.

Storage Portion

Figure 5:
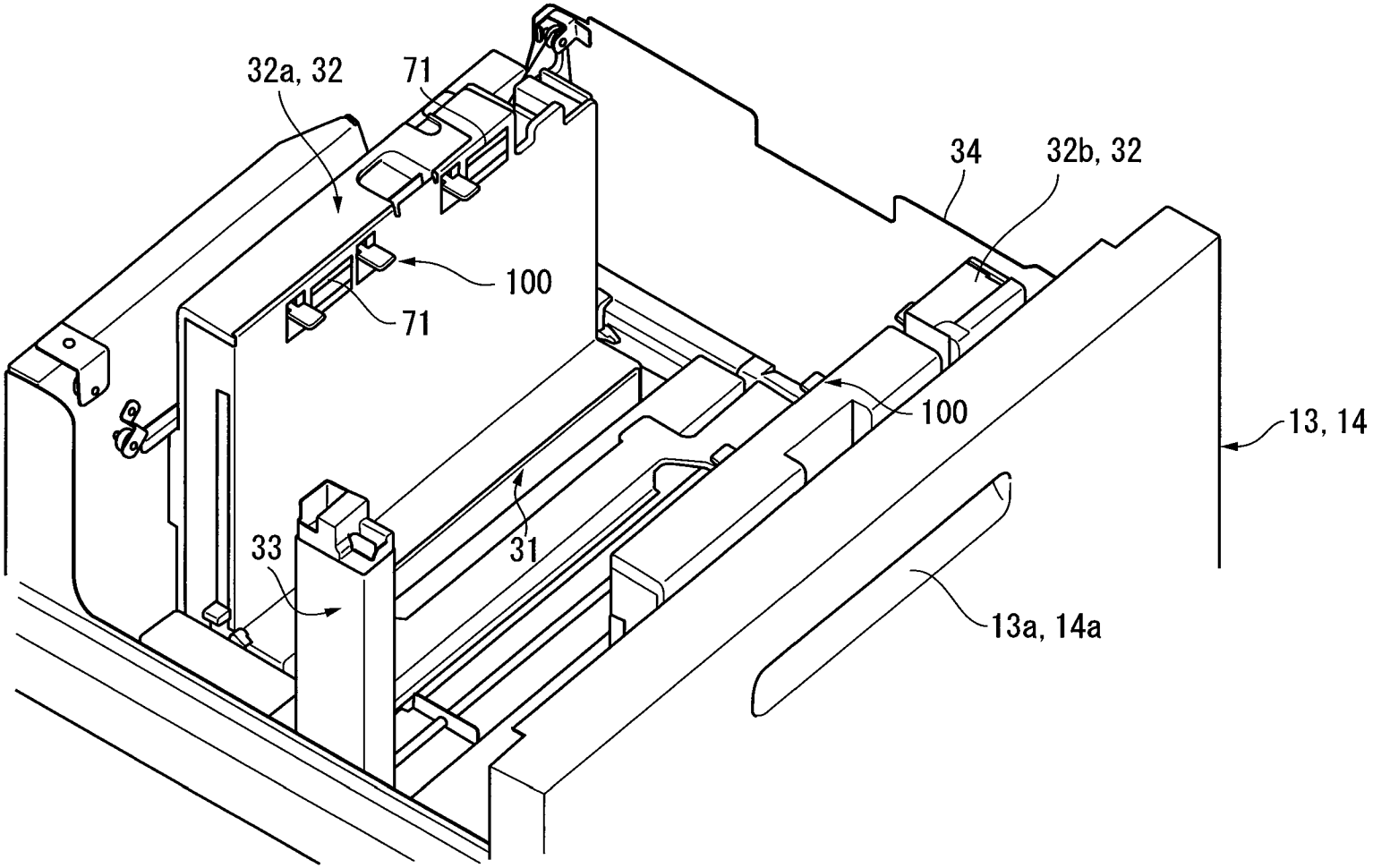
FIG. 5 is a perspective view illustrating a configuration example of a medium storage portion of the medium feeding device according to the first exemplary embodiment.

In this example, as FIGS. 4 and 5 illustrate, the storage portion 30 includes a stacking bottom plate 31 on which media of a variety of sizes are to be stacked. The storage portion 30 further includes: in the width direction intersecting the delivery direction of the media that have a variety of sizes and that are stacked on the stacking bottom plate 31, side guides 32 (specifically, 32*a* and 32*b*) as side guide units that are provided on the sides of the media and that guide the media for positioning the sides of the media; an end guide 33 as a rear guide unit that is disposed on the rear side of the media, which are stacked on the stacking bottom plate 31, upstream in the medium delivery direction and that guides the media for positioning the rear side of the media; and a partition plate 34 that serves as a partition and defines a position of the media, which are stacked on the stacking bottom plate 31, on the downstream side in the medium delivery direction.

In this example, the storage portion 30 may be designed in accordance with the size of a medium to be used, and the medium to be used may be an ordinary-size medium in view of providing versatility. For the ordinary-size medium here, for example, a medium having a length of up to 488 mm in the longitudinal direction may be used, and an example of the medium in such a size is a medium in a size of A3, defined by the Japanese Industrial Standards (JIS), or smaller.

In this example, the side guides 32 are provided so as to move in the width direction of the stacking bottom plate 31 and are to be positioned at predetermined positioning positions. The end guide 33 is provided so as to move forward and backward in the delivery direction of media on the stacking bottom plate 31 and is to be positioned at predetermined positioning positions. In this example, the partition plate 34 has plural stopper pieces 35 (refer to FIG. 8 and, in this example, two pieces are provided) that each protrude upward from the upper edge of the partition plate 34. The stopper pieces 35 function as a stopper wall 36 by which an upper region of media when the fluffing mechanism 70 is not used is retained.

In addition, as FIG. 4 illustrates, the stacking bottom plate 31 is supported by an ascent/descent mechanism 90 (refer to FIG. 10), which will be described below, so as to ascend and descend.

Delivery Roller

Figure 8:
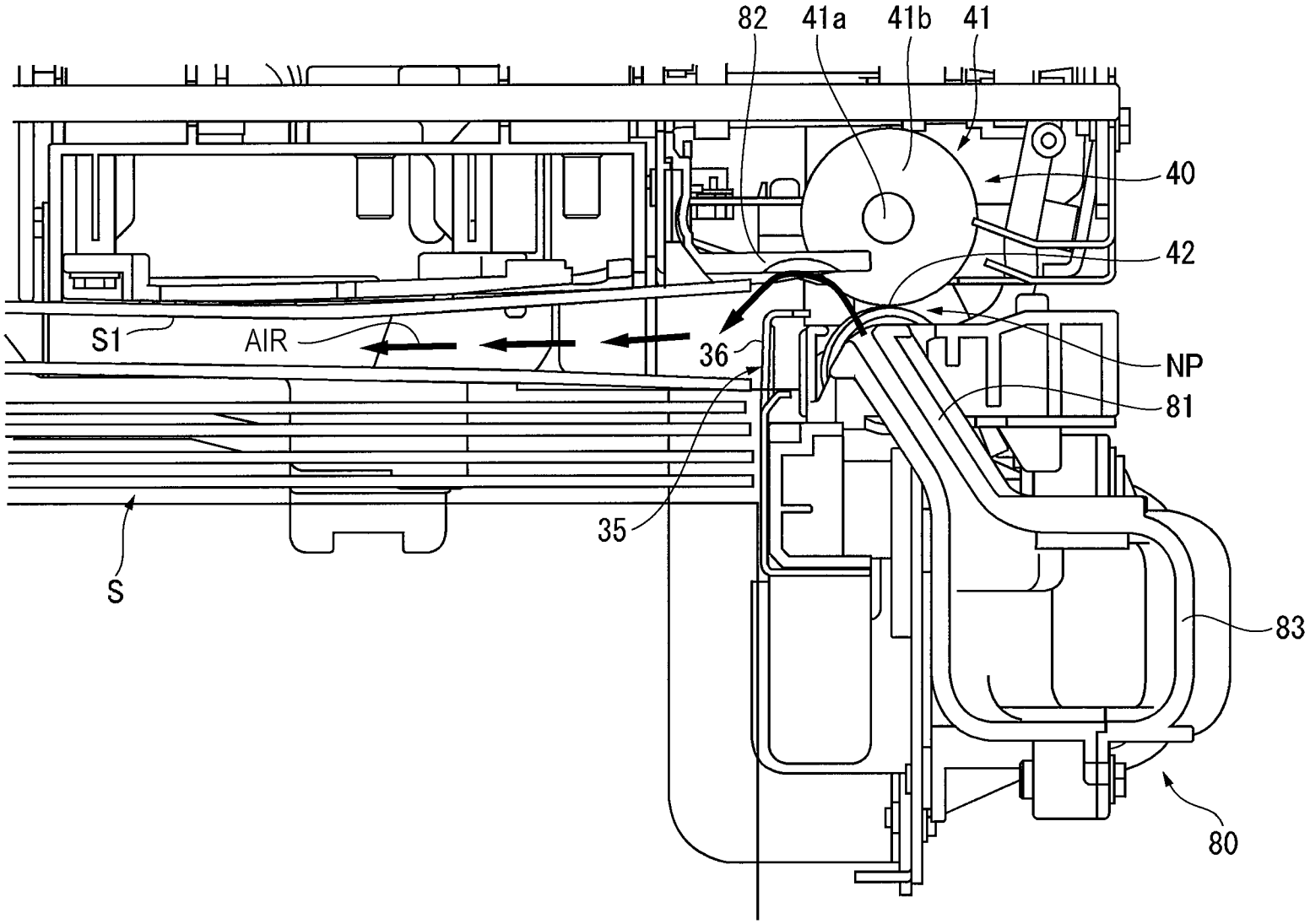
FIG. 8 illustrates a configuration example of an air separation mechanism in FIG. 4.
Figure 11:
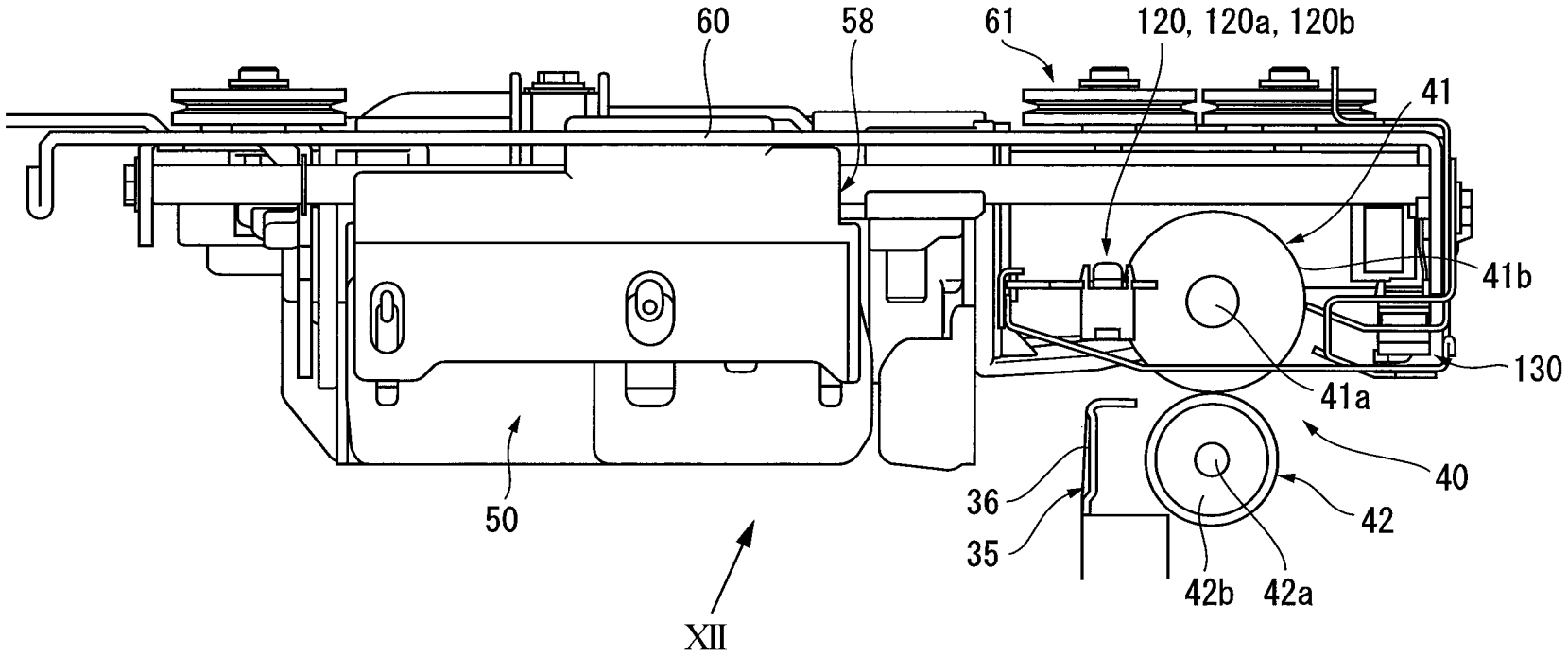
FIG. 11 illustrates a configuration example of a part including the vacuum head and a delivery roller that are used in the first exemplary embodiment.
Figure 12:
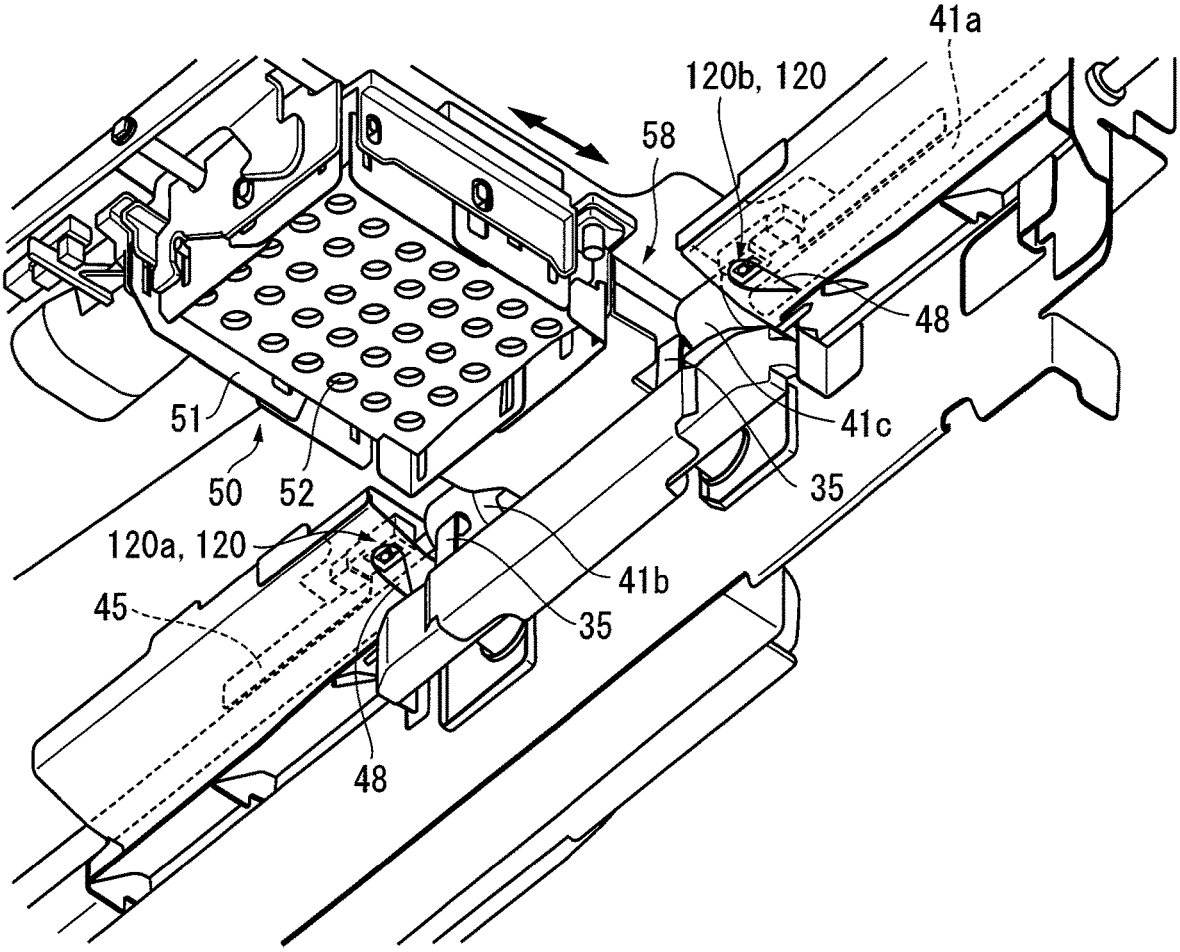
FIG. 12 illustrates the configuration example in FIG. 11 as viewed in direction XII in FIG. 11.
Figure 13:
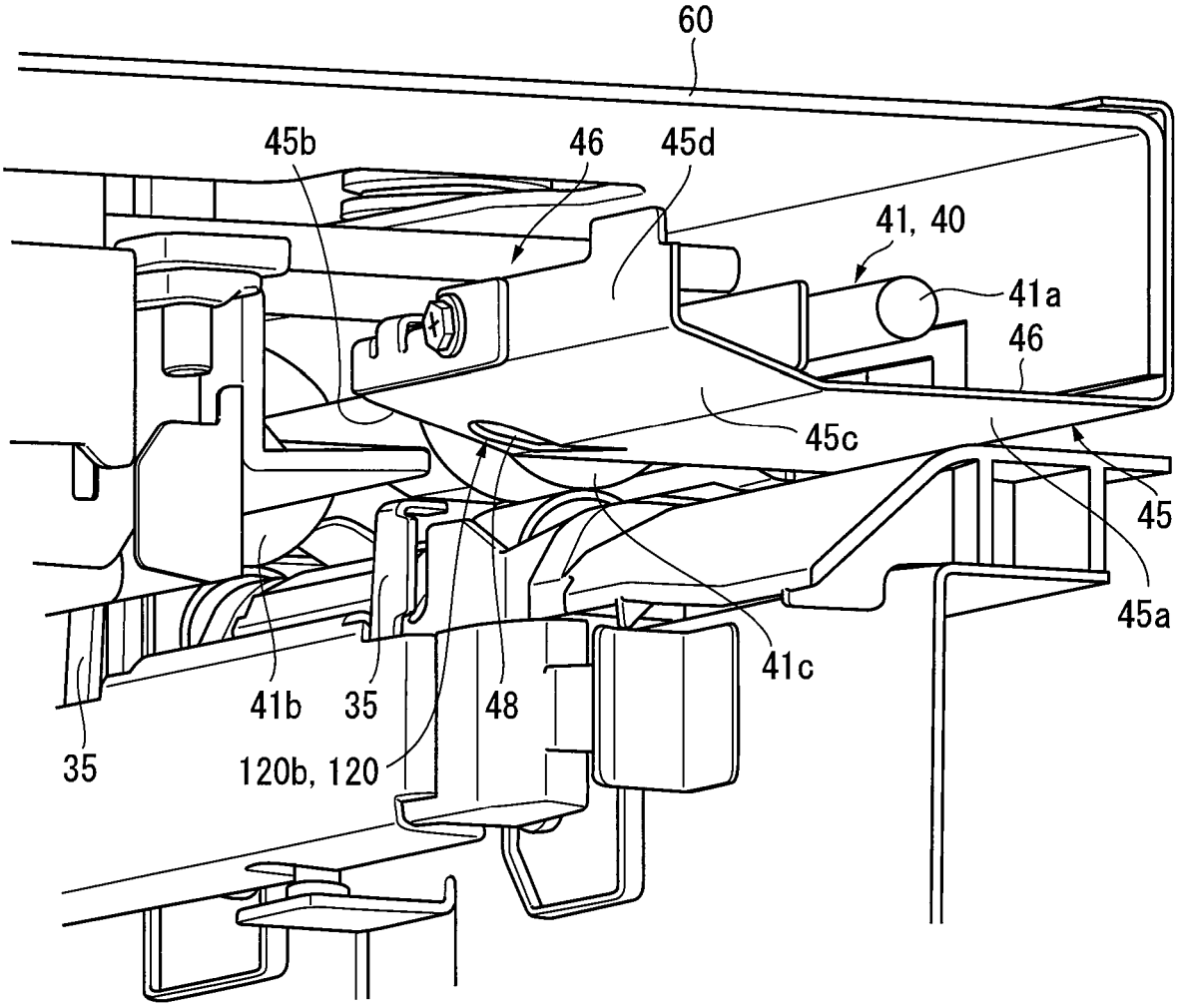
FIG. 13 illustrates a configuration example of a part including a portion to which a position sensor is attached.

In this example, as FIGS. 4, 8, and 11 illustrate, the delivery roller 40 has a driving roller 41 including a drive shaft 41*a* that performs rotatable driving and plural divided roller bodies 41*b* and 41*c* around the drive shaft 41*a*, a driven roller 42 that is rotatably driven by following the rotation of the driving roller 41 and that includes a rotation shaft 42*a* and plural divided roller bodies 42*b* and 42*c* around the rotation shaft 42*a*. The delivery roller 40 transports a medium by nipping the medium at contact portions NP of the driving roller 41 and the driven roller (specifically, corresponding to a nip region between the divided roller bodies 41*b* and 42*b* and a nip region between the divided roller bodies 41*c* and 42*c*).

When being denoted collectively, the divided roller bodies 41*b* and 42*b* are referred to as a "divided roller 43". When being denoted collectively, the divided roller bodies 41*c* and 42*c* are referred to as a "divided roller 44".

Vacuum Head

Figure 6:
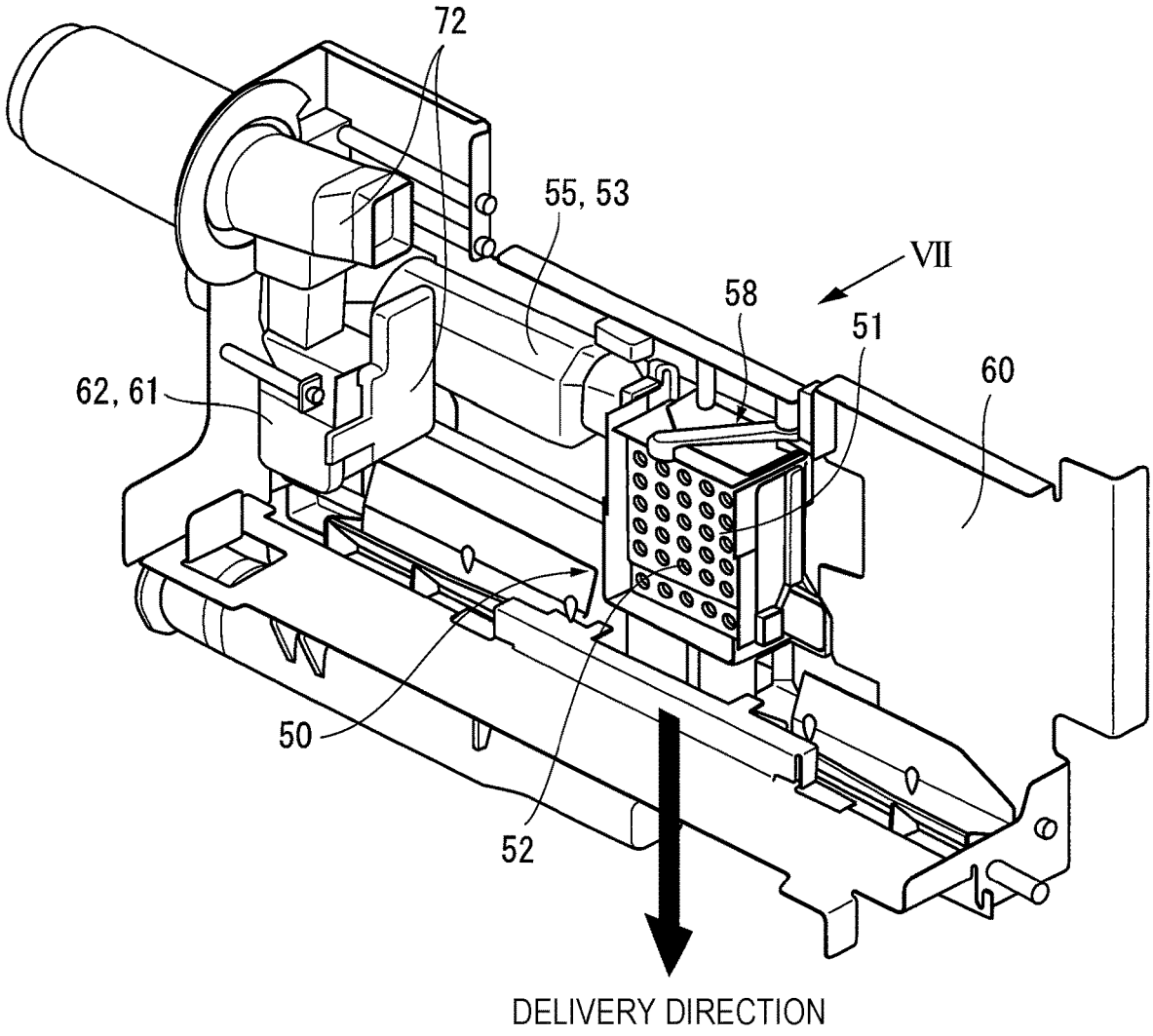
FIG. 6 illustrates the details of a vacuum head, as a transfer unit, according to the first exemplary embodiment.
Figure 7:
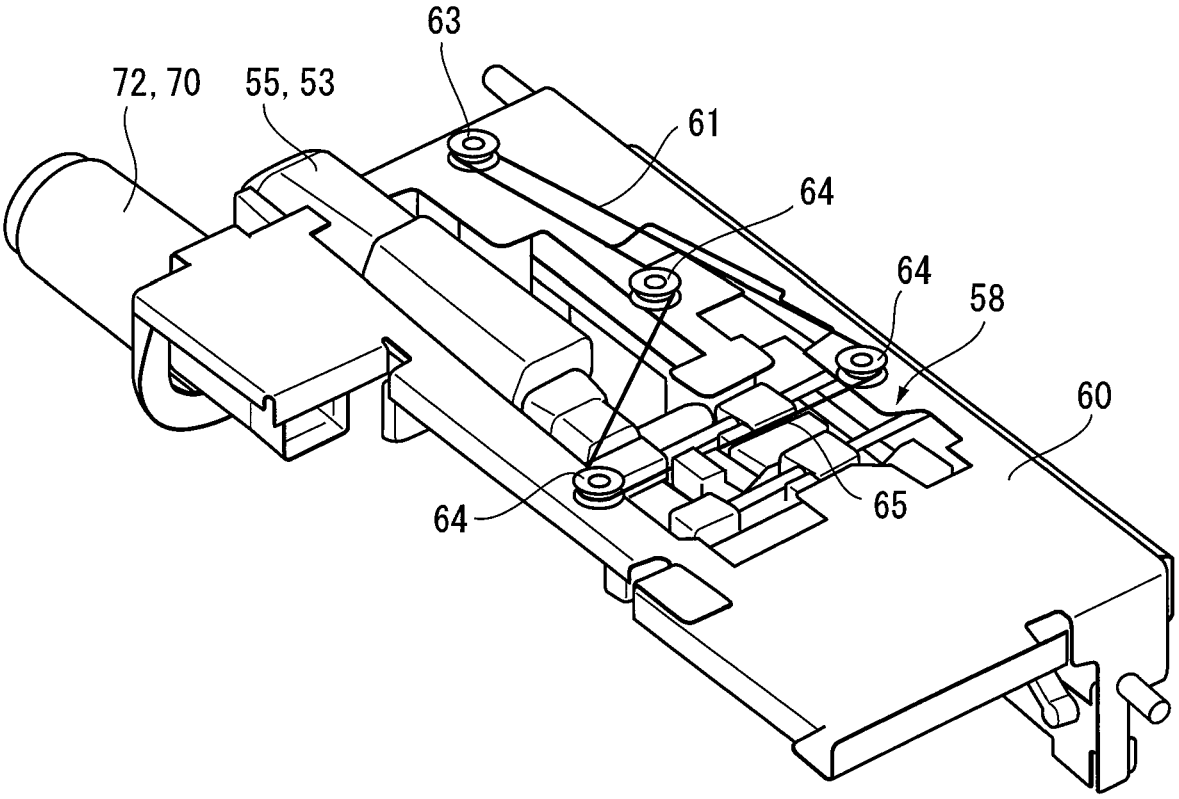
FIG. 7 illustrates the vacuum head in FIG. 6 as viewed in direction VII in FIG. 6.
Figure 9A:
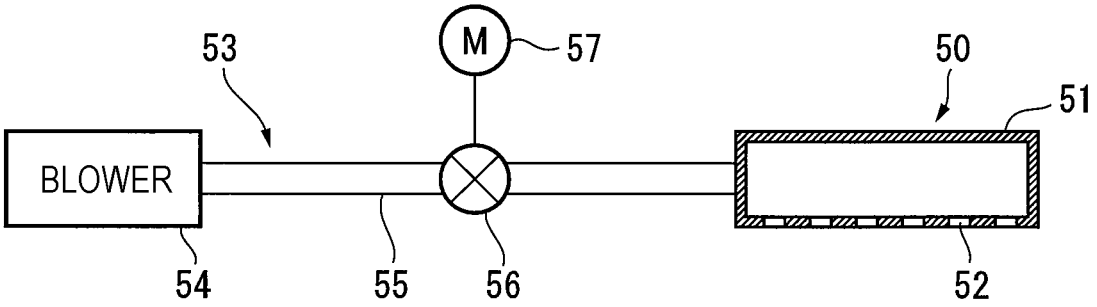
FIG. 9A illustrates a configuration example of a suction mechanism for the vacuum head in FIG. 4.

In this example, as FIGS. 6, 7, and 9A illustrate, the vacuum head 50 is supported by a head frame 60, which is fixed to the housing 12 at a position above the storage portion 30, by using a guide mechanism 58 (for example, a guide rod is used), and the vacuum head 50 is provided so as to advance and retreat in the medium delivery direction.

In this example, the vacuum head 50 has a head body 51 having a hollow boxy shape. A surface of the head body 51 facing media stored in the storage portion 30 has a large number of vacuum holes 52, and a suction mechanism 53 is connected to the head body 51. The suction mechanism 53 here adopts a configuration in which a blower 54 for suction and the head body 51 are coupled to one another by a vacuum duct 55, in the middle of which, a vacuum valve 56 that opens and closes a flow passage is interposed, and the vacuum valve 56 is opened and closed by a valve motor 57.

The head frame 60 has an advancing/retreating mechanism 61 that causes the vacuum head 50 to advance and retreat. In this example, as FIGS. 6 and 7 illustrate, the advancing/retreating mechanism 61 has a configuration in which a stepping motor 62 is fixed to the head frame 60, a driving pulley 63 is coupled to the stepping motor 62, the head frame 60 further has the appropriate number of transmission pulleys 64 at appropriate locations, a wire 65 is looped over each of the driving pulley 63 and the transmission pulleys 64, and a portion of the wire 65 is anchored to the vacuum head 50. In this example, the driving pulley 63 rotates in accordance with the rotation of the stepping motor 62 in the forward and reverse directions. With the rotation of the driving pulley 63, the wire 65 moves by a predetermined amount, and the vacuum head 50 thus advances and retreats in the medium delivery direction.

Fluffing Mechanism

Figure 9B:
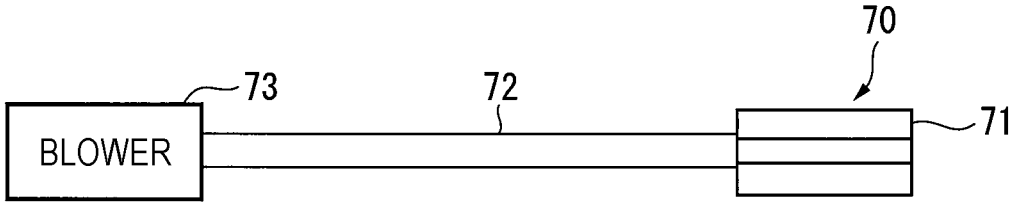
FIG. 9B illustrates a configuration example of a fluffing mechanism in FIG. 4.

In this example, as FIGS. 4, 5, and 9B illustrate, the fluffing mechanism 70 has a configuration in which, for example, each of the side guides 32 (32*a* and 32*b*) has a hollow boxy shape, plural air blowing ports 71 are formed in an upper portion of the side guide 32 facing a side of media, an air duct 72 is provide in a hollow of the side guide 32, one end of the air duct 72 is in communication with the corresponding air blowing port 71, and the other end of the air duct 72 is in communication with a blower 73 that is for blowing. The blower 73 may be built into the side guide 32 or attached externally to the side guide 32.

In addition, in this example, a medium regulating portion 100 is provided near the corresponding air blowing port 71 of the side guide 32. Each medium regulating portion 100 is provided beside media stacked on the stacking bottom plate 31 and protrudes into a media storage region so as to regulate an excessive amount of fluffing of a medium that is fluffed when the fluffing mechanism 70 is used.

Air Separation Mechanism

Figure 9C:
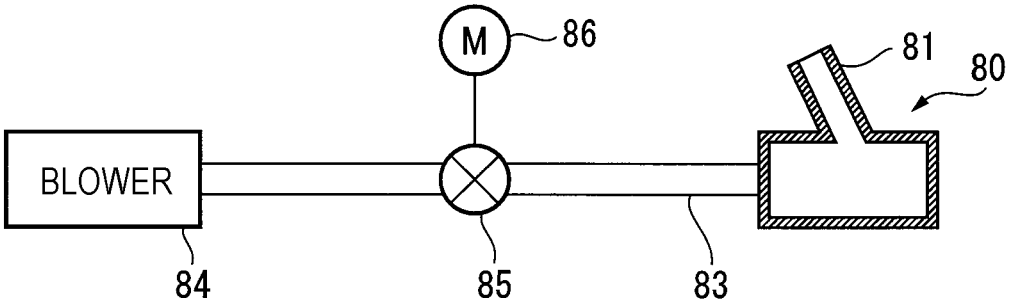
FIG. 9C illustrates an example of an air supply system for the air separation mechanism in FIG. 4.

In this example, as FIGS. 4, 8, and 9C illustrate, the air separation mechanism 80 has an air nozzle 81 that blows knife-shaped air backward and diagonally upward from the lower side toward a downstream end portion, in the delivery direction, of a medium that is fluffed by the fluffing mechanism 70. The air separation mechanism 80 causes the air that has been blown from the air nozzle 81 to change directions by using an air guide plate 82 and blows the air into a region between an upper-side medium that has been fluffed by the fluffing mechanism 70 and media below the upper-side medium to separate the fluffed medium from the other media.

In this example, an air duct 83 is in communication with the air nozzle 81, and a blower 84 for blowing air is connected to the air duct 83. An opening/closing valve 85 that opens and closes a flow passage is provided in the middle of the air duct 83 and opened and closed by using a valve motor 86.

Ascent/Descent Mechanism

Figure 10A:
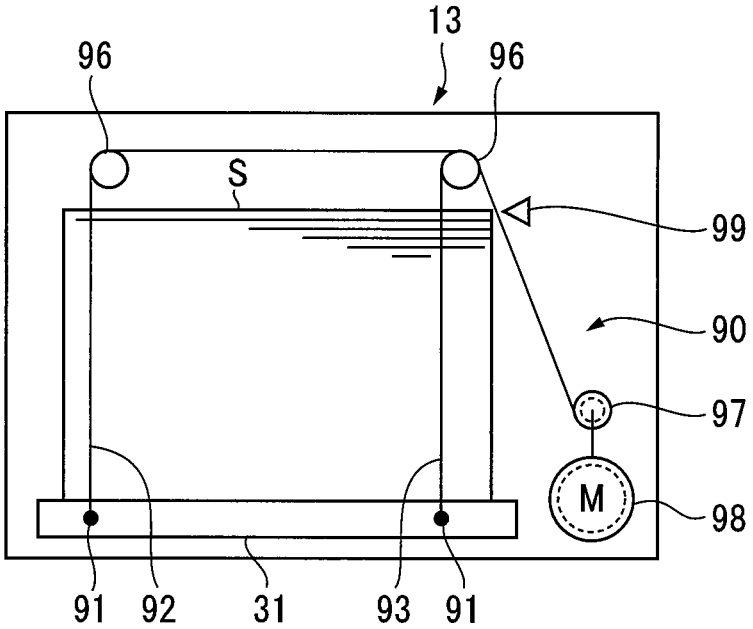
FIG. 10A illustrates a configuration example of an ascent/descent mechanism in FIG. 4.
Figure 10B:
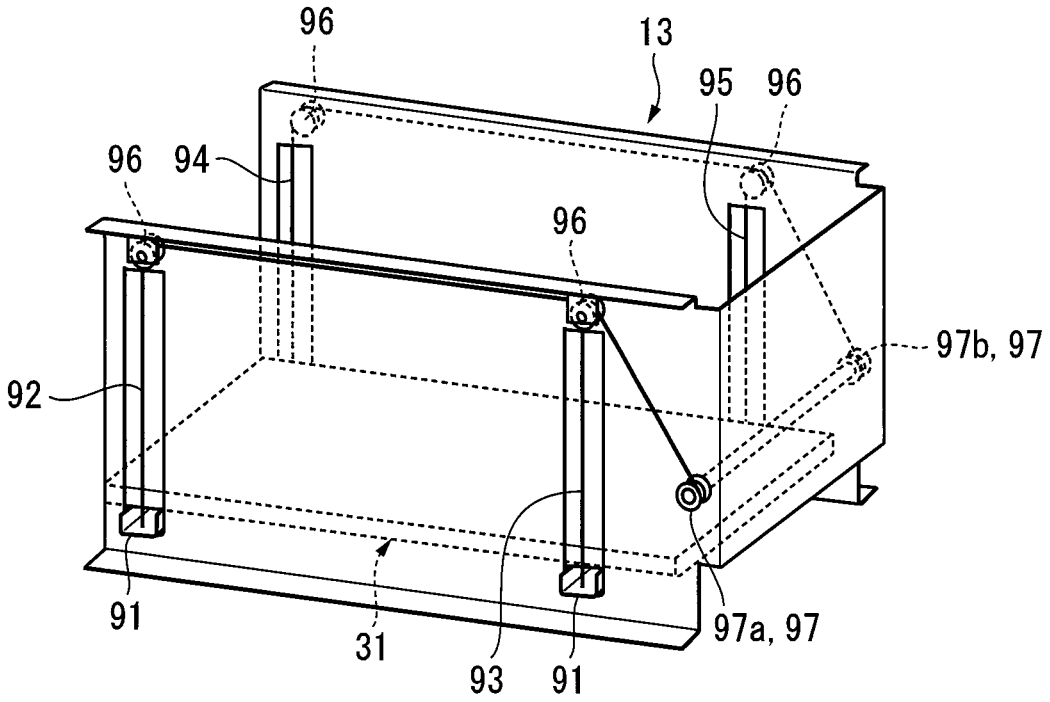
FIG. 10B is a partial perspective view of the ascent/descent mechanism in FIG. 10A.

As FIGS. 4, 10A, and 10B illustrate, in the ascent/descent mechanism 90, suspending portions 91 are provided at four locations on both sides of the stacking bottom plate 31 in the width direction intersecting the medium delivery direction. Four wires 92, 93, 94, and 95 are provided so that an end of each of the wires 92 to 95 is coupled to the corresponding suspending portion 91. Each of the wires 92 to 95 is looped over one or plural guide pulleys 96, and the other side end of each of the wires 92 to 95 is anchored to a corresponding pulley of winding pulleys 97 (in this example, 97*a* and 97*b*) that are coupled to one another by a common shaft. The ascent/descent mechanism 90 causes the stacking bottom plate 31 to ascend and descend while the stacking bottom plate 31 maintaining the parallel orientation by each of the wires 92 to 95 moving by a predetermined amount due to the winding pulleys 97 being rotated by a driving motor 98 that is capable of rotating in the forward and reverse directions. Reference 99 denotes a height sensor for setting a surface of the media stacked on the stacking bottom plate 31 to a predetermined height position.

Position Sensors

In the present exemplary embodiment, as FIGS. 4 and 11 illustrate, across the delivery roller 40 in the medium delivery direction, prior stage position sensors 120 (corresponding to the position detection units 5 in FIG. 1) are arranged upstream, and a later stage position sensor 130 is arranged downstream.

Figure 16:
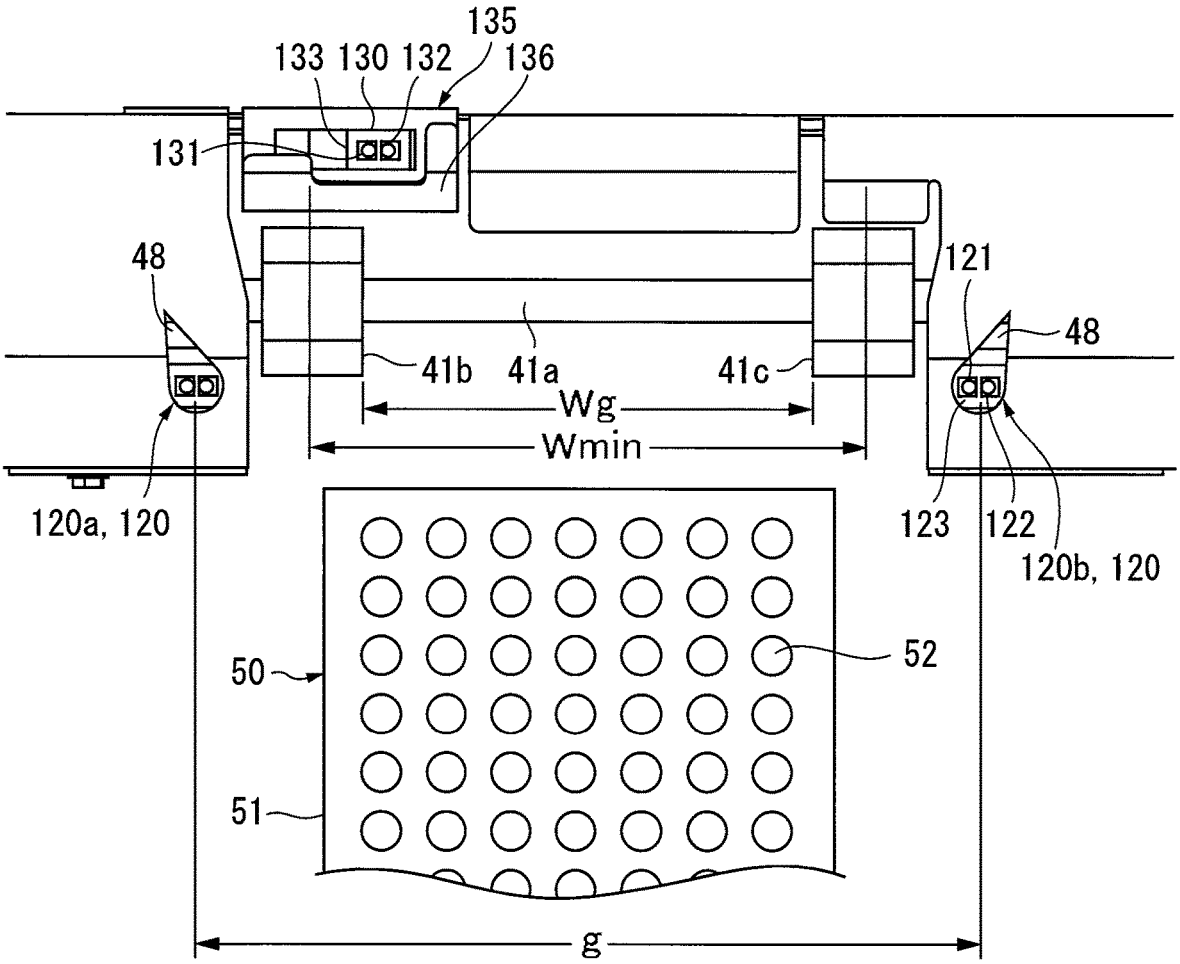
FIG. 16 illustrates arrangement locations of the position sensors in the axial direction of the delivery roller.

For example, as FIG. 16 illustrates, each of the prior stage position sensors 120 has a sensor housing 123 in which a light-emitting element 121 that radiates light toward a medium that is delivered and a light-receiving element 122 that receives reflected light by the medium are arranged side by side. The prior stage position sensors 120 are capable of detecting that a downstream end portion, in the delivery direction, of the medium passes the prior stage position sensors 120, at the timing when the light-receiving elements 122 receive light. The later stage position sensor 130 has a configuration substantially similar to the prior stage position sensor 120.

Layout of Prior Stage Position Sensors

In this example, as FIGS. 4 and 11 to 16 illustrate, the plural prior stage position sensors 120 are arranged at locations (in this example, two locations) in a region R that is on the delivery roller 40 side relative to a downstream end portion, in the delivery direction, of a medium stored in the storage portion 30 and that does not reach nip regions (medium contact portions) NP of the delivery roller 40.

The prior stage position sensors 120 (specifically, 120*a* and 120*b*) are arranged in the width direction intersecting the medium delivery direction, that is, in the axial direction of the delivery roller 40, with a distance g therebetween and detect a position of the downstream end portion of the medium in the medium delivery direction.

Figure 15:
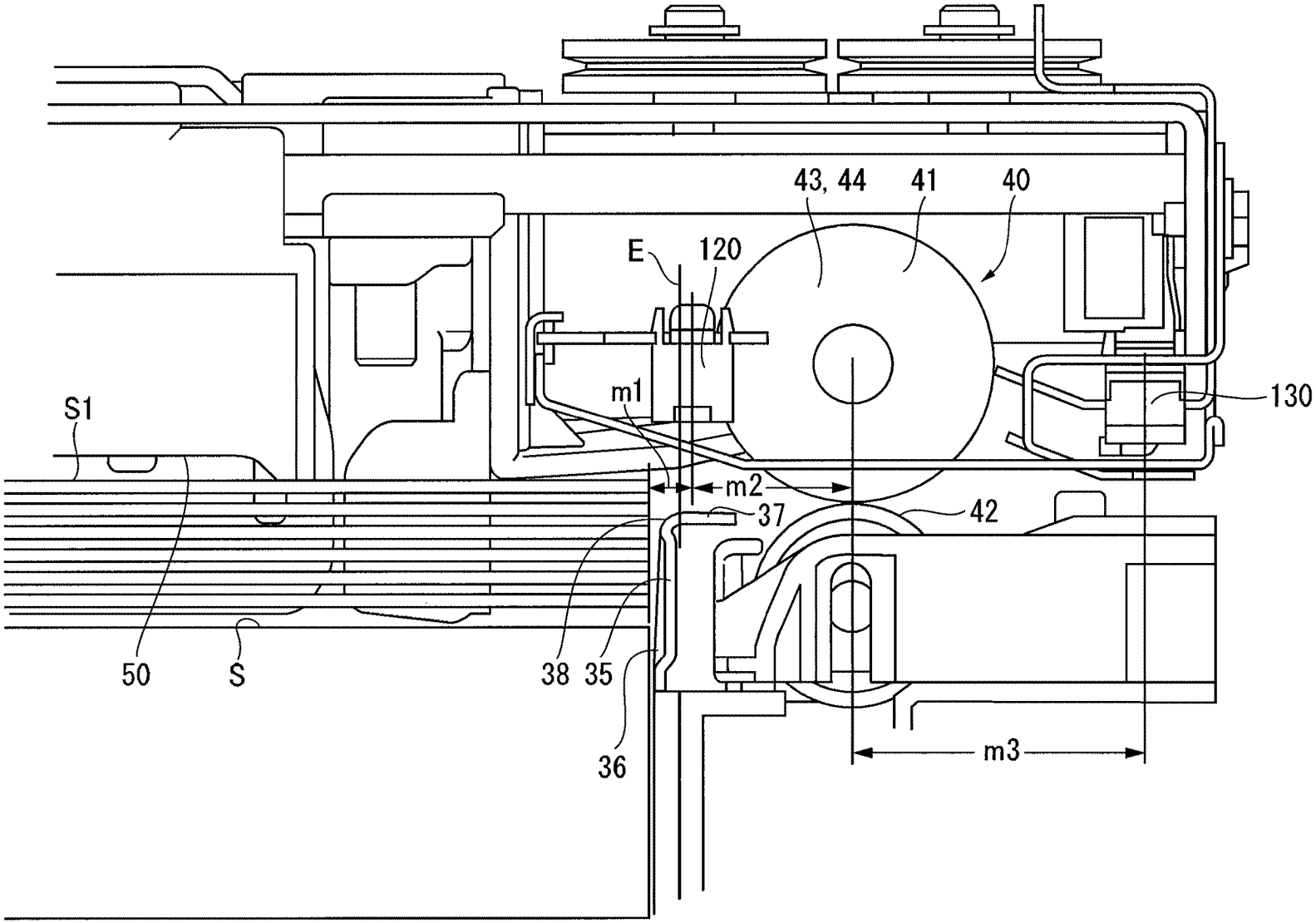
FIG. 15 illustrates arrangement locations of the position sensors in a medium delivery direction.

Regarding a layout, as FIGS. 11 and 15 illustrate, the prior stage position sensors 120 may be arranged closer to a position of the downstream end portion, in the delivery direction, of the medium stored in the storage portion 30 than to the nip regions NP of the delivery roller 40.

Here, because the downstream end portion, in the delivery direction, of the medium that is stored in the storage portion 30 is retained by the stopper wall 36, which is constituted by the stopper pieces 35, provided on the partition plate 34 of the storage portion 30, it is possible to select arrangement positions of the prior stage position sensors 120 relative to the position of the stopper wall 36.

In such a case, the arrangement positions of the prior stage position sensors 120 may be selected so as to satisfy the relationship: m1<m2, when m1 represents a distance between the stopper wall 36 and the center position of a detection surface (specifically, a detection surface of the light-receiving element 122) of each of the prior stage position sensors 120, and ms2 represents a distance between the center position of each of the nip regions NP of the delivery roller 40 and the center position of the detection surface of each of the prior stage position sensors 120.

However, when m1 is set to an excessively short distance, there arises a concern that, even if an end of a medium stored in the storage portion 30 protrudes slightly downstream in the medium delivery direction from the stopper wall 36, the downstream end portion of the medium may pass the prior stage position sensors 120, thereby potentially causing false detection.

Thus, in this example, as FIG. 15 illustrates, each of the stopper pieces 35 has a bent protrusion piece 37, which is bent downstream in the medium delivery direction, on a tip portion of the stopper piece 35. The stopper piece 35 is formed in a manner such that a boundary portion between the stopper piece 35 and the bent protrusion piece 37 is formed as a curved portion 38 having a predetermined radius of curvature r. In this example, the bent protrusion piece 37 has a function of guiding a medium when the medium is delivered. If a non-curved portion is used instead, a medium is likely to be caught by the non-curved portion. Thus, the curved portion 38 is formed to have such a shape to avoid the event.

In this example, m1 is selected so that m1 is located in a region on the delivery roller 40 side relative to termination position E of the curved portion 38 of the stopper piece 35 (the region corresponds to a region on the right side in FIG. 15). Such a configuration is based on the premise that, when at an initial position, a medium stored in the storage portion 30 is unlikely to run onto a portion of the curved portion 38 at termination position E.

Although a distance L between the prior stage position sensors 120 (120*a* and 120*b*) in the axial direction of the delivery roller 40 may be selected as appropriate, the distance L may be set as short as possible in view of application to a small medium.

In this example, as FIG. 16 illustrates, in view of delivering a minimum-size medium, width Wmin that is a width of the minimum-size medium needs to be larger than gap dimension Wg between the divided roller 43 (corresponding to a pair of the divided roller bodies 41*b* and 42*b*) and the divided roller 44 (corresponding to a pair of the divided roller bodies 41*c* and 42*c*) of the delivery roller 40, and side portions of the minimum-size medium in the width direction of the medium need to be nipped by the respective divided rollers 43 and 44 of the delivery roller 40 in the respective nip regions NP.

In this example, in particular, because the vacuum head 50 has a function of sticking to a fluffed medium S1 by suction and transferring the medium S1 to the delivery roller 40, the vacuum head 50 is required to approach the nip regions NP of the delivery roller 40 when transferring the medium to the delivery roller 40. Thus, a moving range in which the vacuum head 50 advances and retreats is required to be within the gap dimension Wg between the divided rollers 43 and 44 of the delivery roller 40 and close to the nip regions NP of the delivery roller 40.

Thus, the prior stage position sensors 120 (120*a* and 120*b*) are unable to be arranged in a region that faces gap dimension Wg between the divided rollers 43 and 44 of the delivery roller 40 on the storage portion 30 side because the prior stage position sensors 120 may interfere with advancement and retreat of the vacuum head 50 in the moving range of the vacuum head 50. It is also difficult to arrange the prior stage position sensors 120 (120*a* and 120*b*) in a region that faces the divided rollers 43 and 44 of the delivery roller 40 and that is on the storage portion 30 side because the presence of the divided rollers 43 and 44 may be an obstacle.

Accordingly, in the present exemplary embodiment, the prior stage position sensors 120 (120*a* and 120*b*) are arranged, in the axial direction of the delivery roller 40, on the outer sides of the divided rollers 43 and 44 of the delivery roller 40 in close proximity to the divided rollers 43 and 44. Thus, in this example, the prior stage position sensors 120 (120*a* and 120*b*) are capable of detecting a state of a downstream end portion, in the delivery direction, of media having sizes except for a minimum size.

Although, in this example, gap dimension Wg of the divided rollers 43 and 44 of the delivery roller 40 is selected so that the sides of a minimum-size medium are nipped, if it is possible to select gag dimension Wg so that inner-side portions of the minimum-size medium in the width direction thereof are nipped, the prior stage position sensors 120 are able to be arranged so as to also perform detection for the minimum-size medium.

Attachment Structure of Prior Stage Position Sensors

In this example, as FIGS. 11 to 16 illustrate, each of the prior stage position sensors 120 is attached to a corresponding attachment portion 46 provided in a portion of a holding frame 45 that holds the driving roller 41 of the delivery roller 40.

The holding frame 45 has a long frame body 45*a* having a substantially L-shaped cross section. Regarding the frame body 45*a*, a rising portion of the frame body 45*a* is fixed to the head frame 60 of the vacuum head 50. A cutout 45*b* having a substantially rectangular shape is formed at the substantial center of a horizontal portion of the frame body 45*a* in the longitudinal direction. In addition, tapered portions 45*c*, which are formed in the horizontal portion, each extend diagonally upward and taper as the distance from the rising portion increases. The cutout 45*b* here is an opening provided so that portions of the divided roller bodies 41*b* and 41*c* of the driving roller 41 are located lower than the horizontal portion to be exposed from the horizontal portion, and each of the tapered portions 45*c* functions as a guide chute for guiding a downstream end portion, in the delivery direction, of a fluffed medium to the nip regions NP of the delivery roller 40.

In this example, the attachment portions 46 are provided on both sides, in the longitudinal direction, of the cutout 45*b* of the horizontal portion of the holding frame 45. Each of the attachment portions 46 has a configuration in which a sensor bracket 47 having a substantially L-shaped cross section is anchored to a folded portion 45*d* formed on an end of the horizontal portion of the holding frame 45 by using a fastener, the sensor bracket 47 is disposed so as to protrude in a form of a visor from the folded portion 45*d* in substantially parallel with the horizontal portion of the holding frame 45, and a through opening 48 is formed in a portion of the horizontal portion that faces the sensor bracket 47.

A sensor housing 123 of the prior stage position sensor 120 is positioned and fixed to the sensor bracket 47, and the detection surface that is constituted by the light-emitting element 121 and the light-receiving element 122 is arranged with respect to the through opening 48.

Later Stage Position Sensor

In this example, the later stage position sensor 130 detects whether media S that passed through the nip regions NP of the delivery roller 40 have passed, and the single later stage position sensor 130 is disposed at a position within a region through which a minimum-size medium passes and near the nip region NP of the delivery roller 40.

Figure 14:
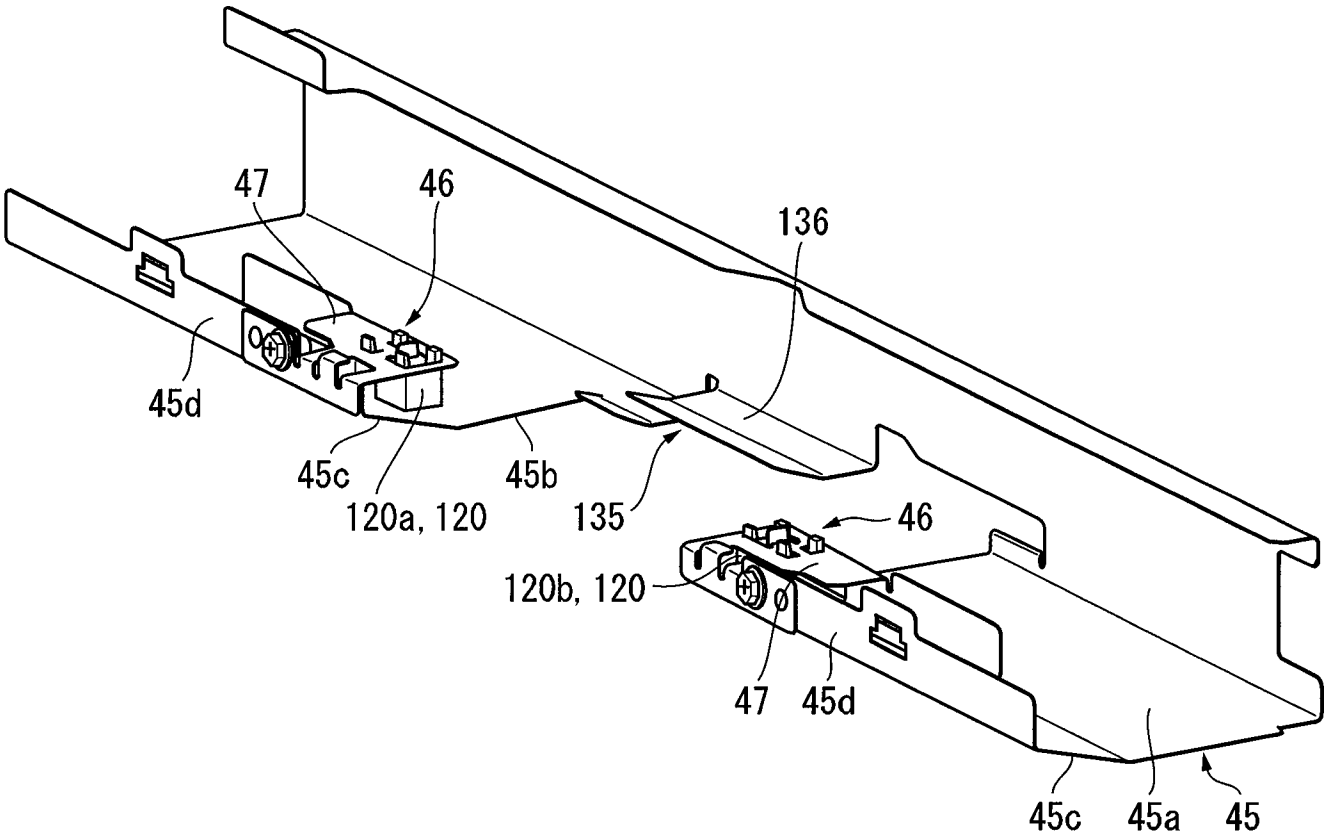
FIG. 14 illustrates a configuration example of a chute to which position sensors are attached.

In this example, as FIGS. 11, 14, and 16 illustrate, the later stage position sensor 130 is attached to an attachment portion 135 provided in the holding frame 45 of the delivery roller 40 and near a rising portion of the cutout 45*b* of the horizontal portion.

In this example, regarding the attachment portion 135, a portion of the rising portion of the holding frame 45 that faces the cutout 45*b* is bent in the substantially horizontal direction to integrally form a sensor bracket 136. The sensor housing 133 of the later stage position sensor 130 is fixed to a lower surface of the sensor bracket 136, and a detection surface that is constituted by a light-emitting element 131 and a light-receiving element 132 is disposed so as to face a region through which a medium passes.

Control System

In this example, as FIG. 4 illustrates, a controller 200 that controls the medium feeding device 11 is provided. The controller 200 is constituted by a microcomputer including, for example, a central processing unit (CPU), a read-only memory (ROM), a random-access memory (RAM), and an input/output (I/O) port. The controller 200 causes the CPU to take in various kinds of information associated with, for example, job designation and to take in signals received from position sensors (for example, the prior stage position sensors 120 and the later stage position sensor 130), calculates following the program that has been installed in the ROM in advance, and transmits predetermined control signals to the respective control targets.

In this example, the control targets include, for example, the delivery roller 40, the vacuum head 50 (the suction mechanism 53 and the advancing/retreating mechanism 61), the fluffing mechanism 70, the air separation mechanism 80, and the ascent/descent mechanism 90. The controller 200 also has a display 210 that displays, for example, the progress of a medium feeding job and an abnormality warning regarding a feeding state of a medium.

Medium Feeding Operation by Medium Feeding Device

In the present exemplary embodiment, when an instruction of a medium feeding job is input into the controller 200, the controller 200, after ensuring that a surface of media S in the storage portion 30 is set to a predetermined position, performs a series of medium feeding operation.

In a typical case, the fluffing mechanism 70 fluffs an upper-side region of the media S, and, following such an operation, the vacuum head 50 sticks to a fluffed medium by suction, advances from the home position toward the delivery roller 40 side, and transfers the medium to the delivery roller 40. During such transfer of the medium, the air separation mechanism 80 operates and blows knife-shaped air into a region between a fluffed upper-side medium S1 and the second and subsequent media S below the medium S1 to separate the fluffed medium from the other media.

The medium S1 that has reached the nip regions NP of the delivery roller 40 is delivered by the driving rotation of the delivery roller 40 and the media are delivered in succession.

The vacuum head 50 that has transferred the medium, after returning to an original position (home position), prepares for the next processing. The air separation mechanism 80 stops blowing air at the time when a separation operation of the medium ends and also prepares for the next processing.

Example of Detection Operation by Prior Stage Position Sensors

In this example, the prior stage position sensors 120 (120*a* and 120*b*) detect whether a downstream end portion, in the delivery direction, of each of the media S that are fed from the storage portion 30 has passed. The prior stage position sensors 120 provide detection results to the controller 200 so that the controller 200 grasps a state of the downstream end portion, in the delivery direction, of each of the media S and determines whether the state is in the permissible range or in the abnormal range that is out of the permissible range.

1. Normal Medium Feeding Case

Figure 17A:
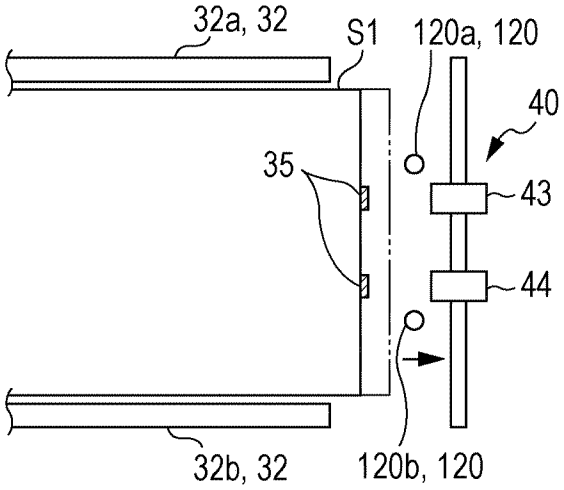
FIG. 17A illustrates a case in which a medium that is fed from the medium storage portion is delivered in a substantially straight line.

As FIG. 17A illustrates, regarding the prior stage position sensors 120 (120*a* and 120*b*), after the vacuum head 50 starts moving a medium S1, a downstream end portion, in the delivery direction, of the medium S1 passes both the prior stage position sensors 120 (120*a* and 120*b*) at substantially the same timing, and a time difference between the detecting times of the prior stage position sensors 120, $\Delta T=|T1-T2|$, is thereby extremely close to zero and does not reach a predetermined threshold value.

2. Abnormal Medium Feeding Example

Figure 17B:
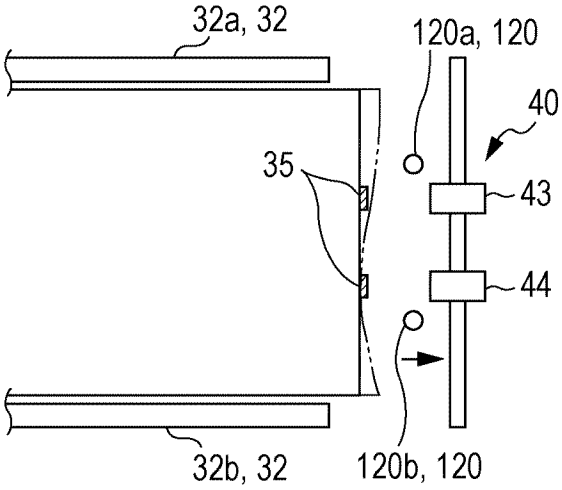
FIG. 17B illustrates a case in which a medium that is fed from the medium storage portion is retained by a stopper wall.

In this example, as FIG. 17B illustrates, a fluffed medium S1 is caught by one or both stopper pieces 35 of the storage portion 30, and the entire region or a one-side region of a downstream end portion, in the delivery direction, of the medium S1 does not move downstream in the medium delivery direction from the storage portion 30. In such a case, even if a predetermined time period tc has elapsed since the vacuum head 50 has started moving from the home position, the prior stage position sensors 120 (120*a* and 120*b*) are unable to detect passage of the entire region or the one-side region of the downstream end portion, in the delivery direction, of the medium S1. Thus, when neither or only one of the prior stage position sensors 120 (120*a* and 120*b*) has reached an ON state even if the predetermined time period tc has elapsed, it is possible to determine that an abnormality in a medium letting-out operation has occurred.

3. Skewed Medium Feeding Example

Figure 17C:
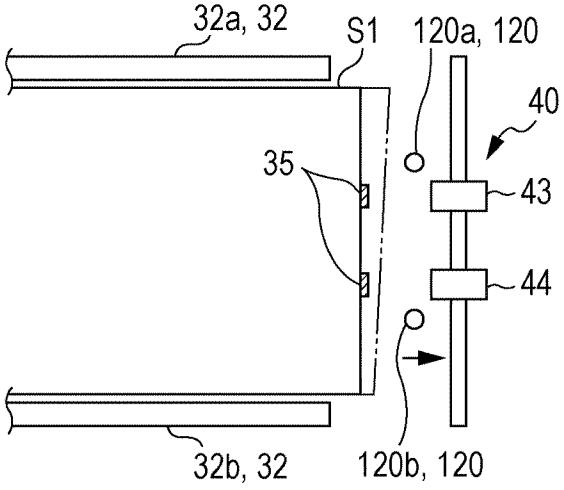
FIG. 17C illustrates a case in which a medium that is fed from the medium storage portion is in a skew state in which the left side of the medium in the width direction is ahead.
Figure 17D:
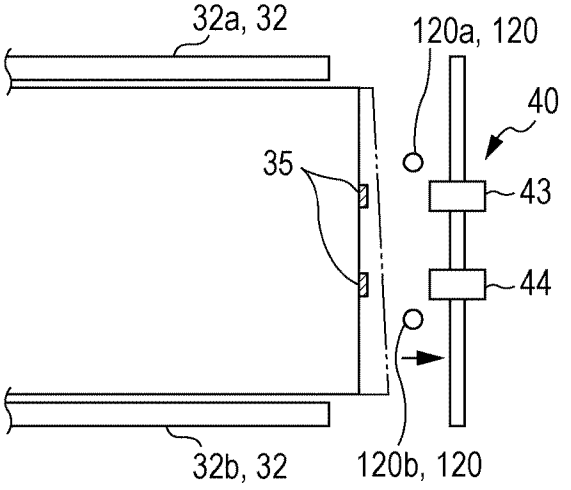
FIG. 17D illustrates a case in which a medium that is fed from the medium storage position is in a skew state in which the right side of the medium in the width direction is ahead.

In this example, as FIG. 17C or 17D illustrates, a fluffed medium S1, which is moved toward the delivery roller 40 side by the vacuum head 50, is being stuck to the vacuum head 50 by suction while being skewed with respect to the vacuum head 50. At this time, as FIG. 17C illustrates, when a left-side region of the medium S1 in the width direction is delivered ahead of the other side region, a downstream end portion, in the delivery direction, of the medium S1 passes one prior stage position sensor 120*a* first and passes the other prior stage position sensor 120*b* later. Conversely, as FIG. 17D illustrates, when a right-side region of the medium S1 in the width direction is delivered ahead of the other side region, a downstream end portion, in the delivery direction, of the medium S1 passes one prior stage position sensor 120*b* first and passes the other prior stage position sensor 120*a* later. Thus, a time difference between the detecting times of the prior stage position sensors 120*a* and 120*b*, $\Delta T=|T1-T2|$, is to be a value reflecting such a skew condition. Thus, it is possible to select a threshold value C in advance on the assumption of a case in which the extent of skewing of the medium is extremely high such that the performance of transporting a medium to the processing unit 20 and the medium processing performance of the processing unit 20 are decreased and possible to determine that the time difference $\Delta T$ is in the permissible range when within the threshold value C and determine that the time difference $\Delta T$ is in the abnormal range when exceeding the threshold value C.

Medium Feeding Control

Figure 18:
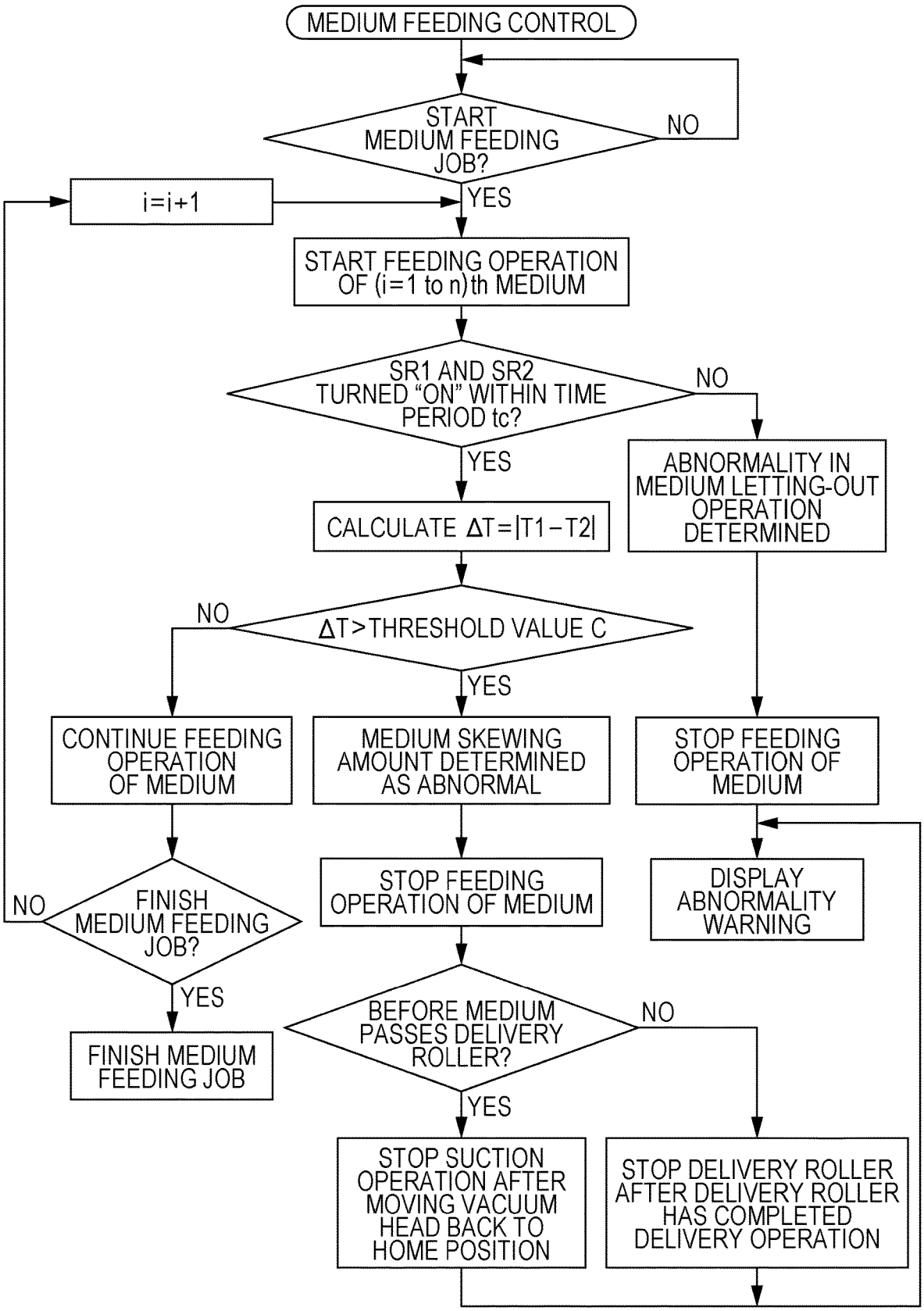
FIG. 18 is a flowchart illustrating a medium feeding control used in the first exemplary embodiment.

FIG. 18 is a flowchart illustrating an example of a medium feeding control performed by the medium feeding device 11.

First, when a job instruction to feed one or plural sheets (n sheets) of media is input, a feeding operation of the first medium is started.

At this time, whether the prior stage position sensors 120 (120*a* and 120*b*: in FIG. 18, denoted by SR1 and SR2, respectively) have been turned ON within the predetermined time period tc is checked. When both have been turned ON, a time difference between the turning-ON times of SR1 and SR2, $\Delta T=|T1-T2|$, is calculated. Conversely, when only one of SR1 and SR2 has been turned ON, it is determined that an abnormality in the medium letting-out operation has occurred, and the feeding operation of the medium is stopped.

Again, after the time difference $\Delta T$ between the turning-ON times of SR1 and SR2 is calculated, $\Delta T>$threshold value C is checked.

Here, when $\Delta T$ is the threshold value C or below, it is determined that a skew state of the medium is normal (within the permissible range), the feeding operation of the medium continues, and the feeding operation in which media are fed individually is continuously performed until the feeding job of the media ends.

On the other hand, when ΔT>threshold value C is satisfied, it is determined that the skew amount of the medium (specifically, the skew amount of the downstream end portion, in the delivery direction, of the medium) is an abnormal amount, and the feeding operation of the medium is stopped.

At this time, whether the medium has passed through the nip regions NP of the delivery roller 40 is checked, and, when the medium has not reached the nip regions NP of the delivery roller 40, a suction operation of the vacuum head 50 is stopped after the vacuum head 50 is moved back to the home position. When a downstream end portion, in the delivery direction, of the medium has passed the nip regions NP of the delivery roller 40, driving of the delivery roller 40 is stopped after the delivery operation by the delivery roller 40 is complete.

Here, when the feeding operation of the medium is stopped, the display 210 illustrated in FIG. 4 may also be caused to display an abnormality warning. By doing so, it is possible for a user to grasp immediately occurrence of an abnormality in the feeding operation of the medium.

Example of Operation under Medium Feeding Control

Figure 19A:
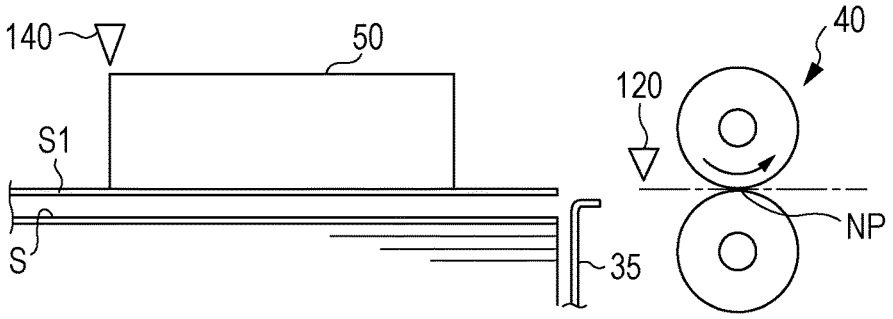
FIG. 19A illustrates an initial position of media that are stored in the medium storage portion.

FIG. 19A is a schematic view illustrating a state in which a feeding operation of a fluffed medium S1 is started.

In FIG. 19A, it is possible to determine whether the vacuum head 50 is at the home position by using, for example, a home position sensor 140. Thus, by monitoring a timing of change of the home position sensor 140, it is grasped that the vacuum head 50 has started moving from the home position.

Figure 19B:
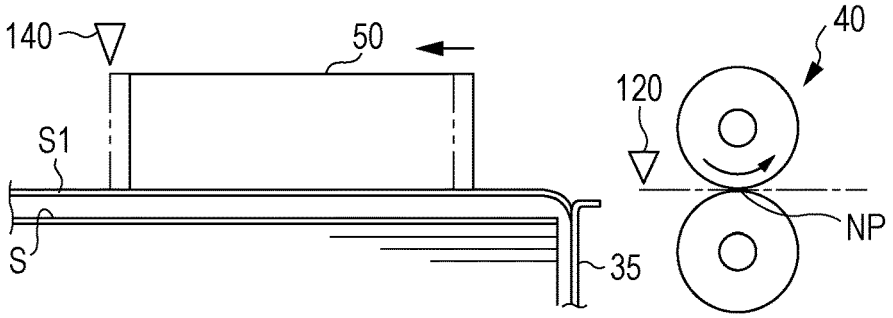
FIG. 19B illustrates a case in which a medium that is fed from the medium storage portion is jammed due to the stopper wall of the medium storage portion.

FIG. 19B illustrates a condition in which a downstream end portion, in the delivery direction, of a fluffed medium S1 is caught by the stopper piece 35 of the storage portion 30. In such a case, even if the predetermined time period tc has elapsed after the vacuum head 50 has started advancing, the medium S1 does not pass the prior stage position sensors 120 (120*a* and 120*b*) and the prior stage position sensors 120 are thus not turned ON. In such a case, after moving the vacuum head 50 back to the home position and returning the medium S1 to the original position, the controller 200 stops the feeding operation of media S.

Figure 19C:
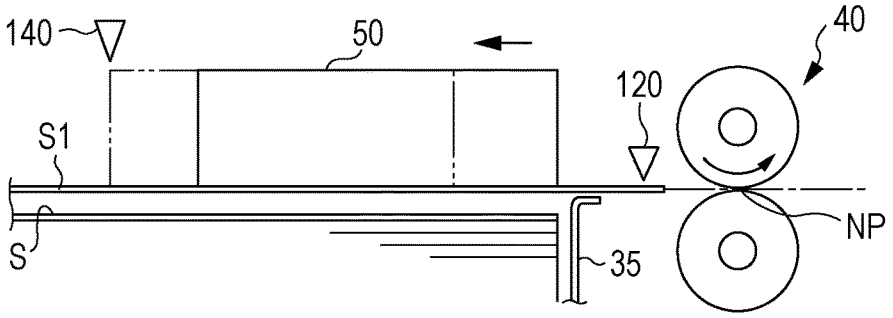
FIG. 19C illustrates a case in which a medium that is fed from the medium storage portion is approaching the delivery roller with the medium being skewed.

FIG. 19C illustrates a condition in which, after the feeding operation of a fluffed medium S1 is started and a downstream end portion, in the delivery direction, of the medium S1 passes the prior stage position sensors 120 (120*a* and 120*b*), it is determined that the skew amount of the medium S1 is an abnormal amount, and the medium S1 has not reached the nip regions NP of the delivery roller 40. In such a case, after moving the vacuum head 50 back to the home position and returning the medium S1 to the original position, the controller 200 stops the feeding operation of media S.

Figure 19D:
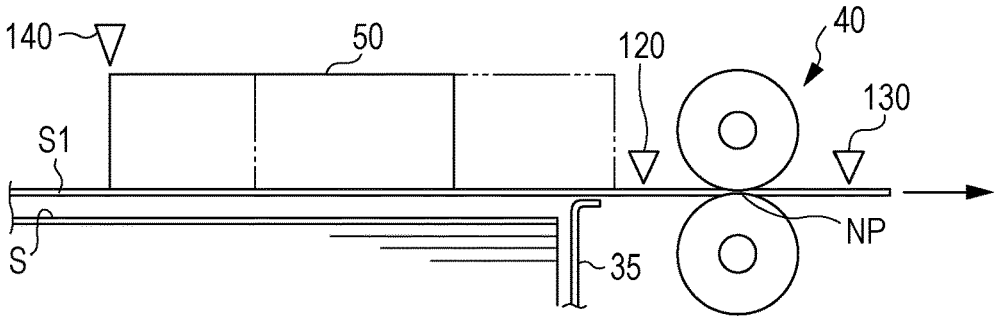
FIG. 19D illustrates a case in which a downstream end portion, in the delivery direction, of a medium that is fed from the medium storage portion is passing through a nip region of the delivery roller with the downstream end portion of the medium being skewed.

FIG. 19D illustrates a condition in which, after the feeding operation of a fluffed medium S1 is started and a downstream end portion, in the delivery direction, of the medium S1 passes the prior stage position sensors 120 (120*a* and 120*b*), although it is determined that the skew amount of the medium S1 is an abnormal amount, the downstream end portion of the medium S1 has passed through the nip regions NP of the delivery roller 40. Here, in this example, it is possible to determine whether the downstream end portion, in the delivery direction, of the medium S1 has passed through the nip regions NP of the delivery roller 40 by whether the downstream end portion of the medium S1 has passed the later stage position sensor 130. When the feeding operation of a medium S1 by the delivery roller 40 is stopped immediately after a downstream end portion, in the delivery direction, of the medium S1 enters the nip regions NP of the delivery roller 40, although the later stage position sensor 130 is away from the nip regions NP of the delivery roller 40 by some distance m3, the medium S1 that has reached the nip regions NP of the delivery roller 40 is often moved to the position of the later stage position sensor 130 by inertia because a driving motor (not illustrated) of the delivery roller 40 is rotated by inertia.

In such a case, after causing the delivery roller 40 to complete the delivery operation, the controller 200 stops the delivery roller 40. Thus, the medium S1 does not remain in the nip regions NP of the delivery roller 40, and it is thereby possible to withdraw, for example, the upper drawer 13 in which a feeding abnormality has occurred.

Second Exemplary Embodiment

Figure 20:
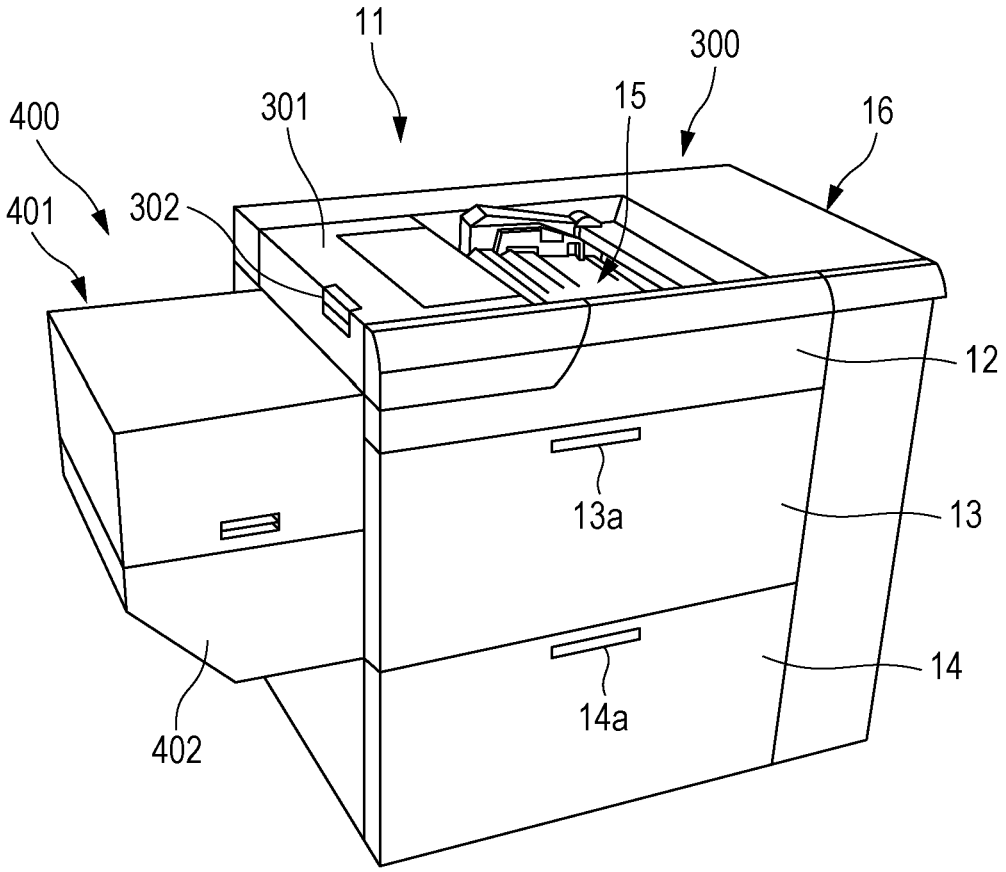
FIG. 20 is an external perspective view of a medium feeding device according to a second exemplary embodiment.

FIG. 20 illustrates a medium feeding device 11 according to a second exemplary embodiment.

In FIG. 20, the basic configuration of the medium feeding device 11 is substantially similar to that of the first exemplary embodiment. Unlike the first exemplary embodiment, it is possible to use, in addition to normal-size media, long media whose length in the longitudinal direction is greater than that of the normal-size media. Constituents similar to those of the first exemplary embodiment are given by references similar to those given in the first exemplary embodiment, and the detailed description of such constituents will be omitted.

In this example, the medium feeding device 11 has a body portion 300 (having a configuration substantially similar to the medium feeding device of the first exemplary embodiment) that is stacked with and feeds normal-size media. By a long size option 400 being added to the body portion 300, it is possible for the medium feeding device 11 to be stacked with and feeds the long media.

In this example, the body portion 300 has a configuration substantially similar to that of the medium feeding device 11 of the first exemplary embodiment. Unlike the first exemplary embodiment, in the body portion 300, an opening to which the long size option 400 is connectable is ensured in a side wall of a housing 12 on a side facing away from the relay unit 16. In addition, at a location that is in an upper portion of the housing 12 and adjacent to the manual feeding portion 15, an opening/closing covering part 301 is provided. The opening/closing covering part 301 is opened and closed with a portion thereof on the manual feeding portion 15 side as a rotation supporting point. In the body portion 300, by operating a handle 302 provided on the opening/closing covering part 301, the opening/closing covering part 301 is opened to ensure a working space when a long medium is set.

Figure 21:
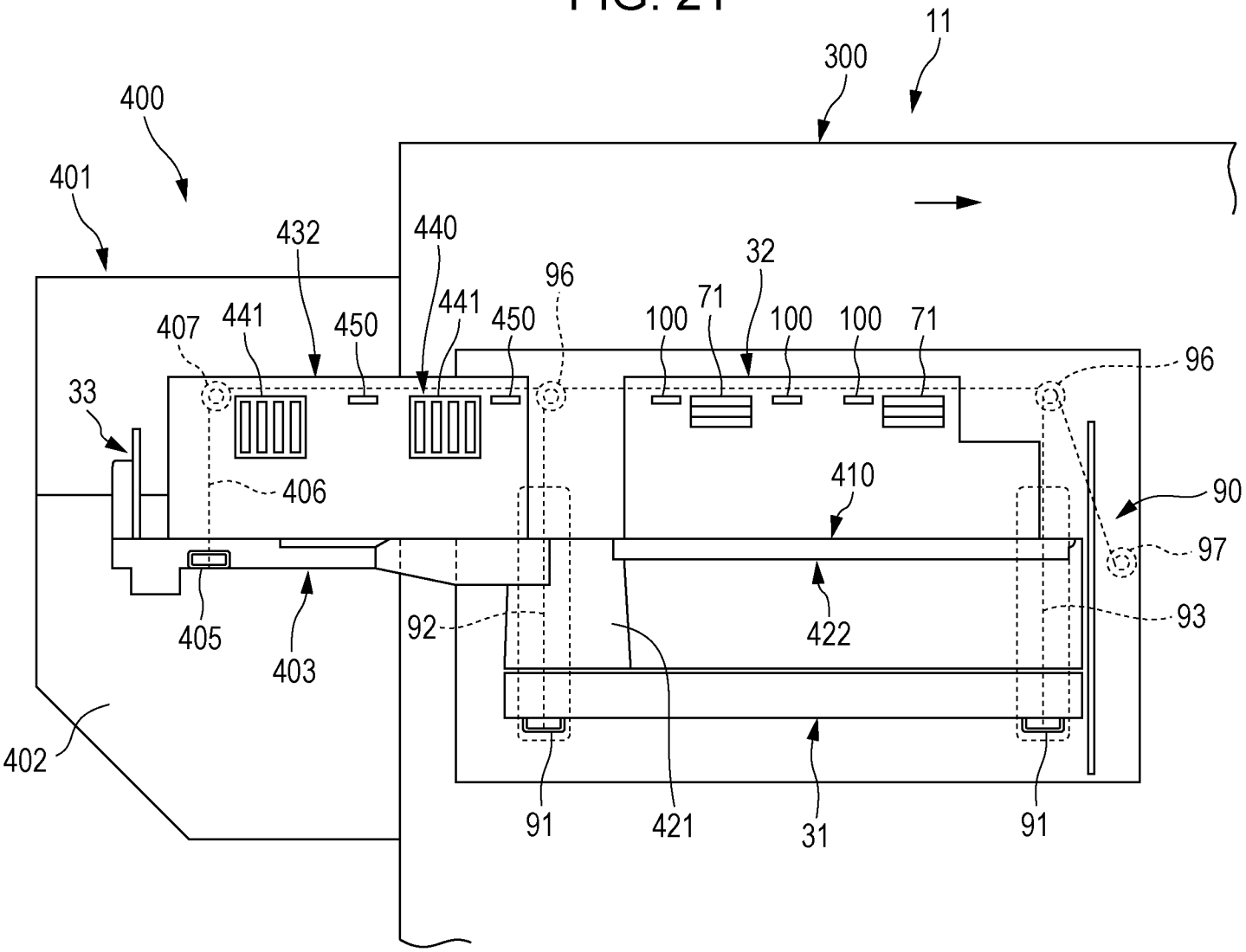
FIG. 21 is a partial front view of the inner structure of the medium feeding device in FIG. 20.
Figure 22:
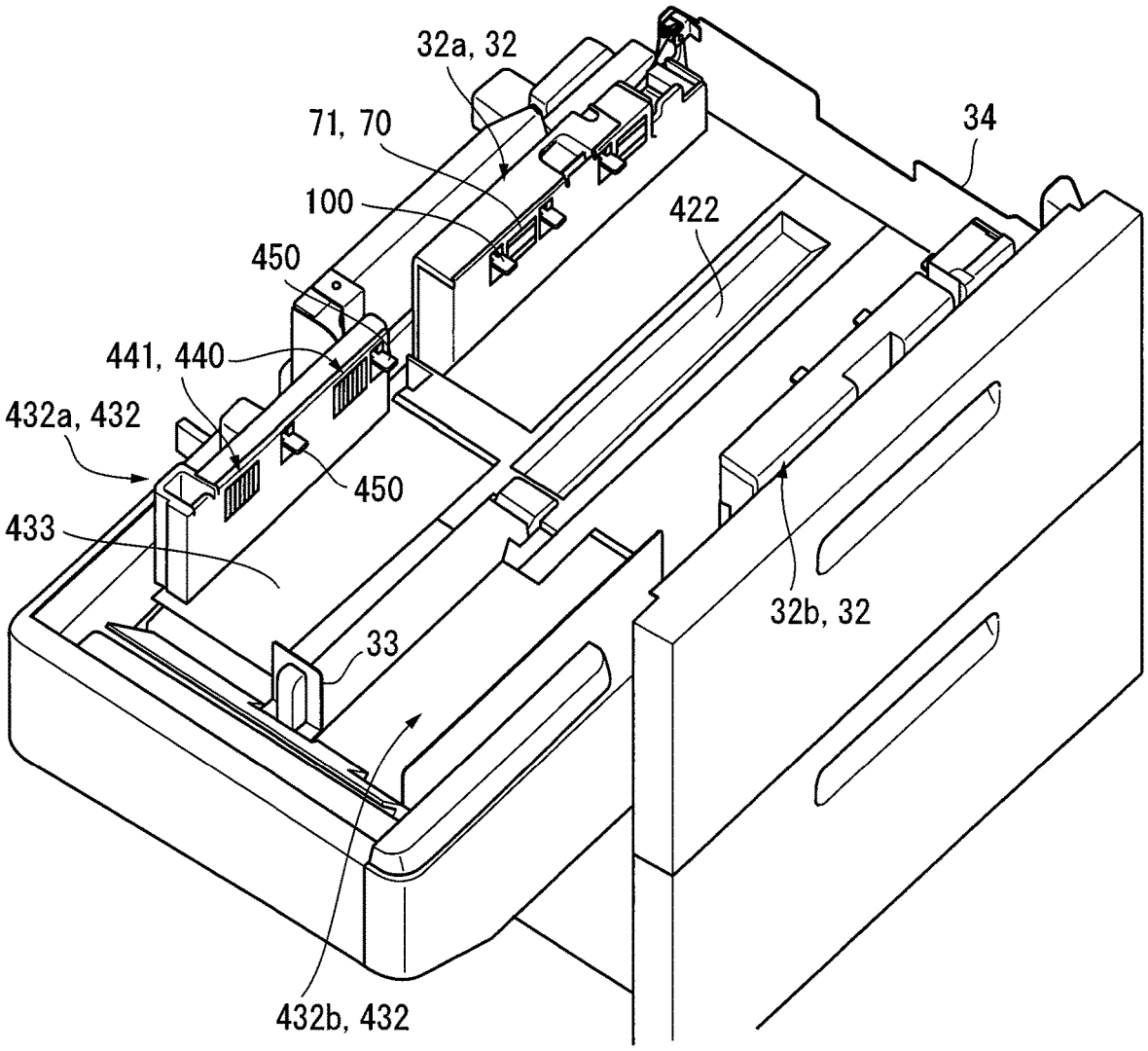
FIG. 22 illustrates partially a storage portion for long media in FIG. 21.

In this example, as FIGS. 20 to 22 illustrate, the long size option 400 includes an addition section 401 that is connected to the opening of the side wall of the body portion 300 on the side facing away from the relay unit 16 and a change section 420 that adds a change to a portion of the configuration in the body portion 300 area.

In this example, regarding the change section 420, a raising base 421 as a raising portion, which is for raising the height of the stacking bottom plate 31, that is disposed on the stacking bottom plate 31 included in the storage portion 30 of the upper drawer 13 in the body portion 300, and a surface portion of the raising base 421 is used as a specialized stacking portion 422 for long media.

Regarding the addition section 401, in an external housing 402, an additional stacking portion 403 is disposed at a location adjacent to a portion of the specialized stacking portion 422 on the side facing away from the delivery roller 40. A stacking surface of the specialized stacking portion 422 and a stacking surface of the additional stacking portion 403 are substantially flush with one another and function together as a long medium stacking portion 410 on which long media are enabled to be stacked. In this example, in particular, the stacking surface for long media is raised with respect to the stacking surface for normal-size media by using the raising base 421. This is because it is intended that the weight of the long media stacked on the long medium stacking portion 410 is decreased to reduce a load applied on an ascent/descent mechanism 90.

Moreover, in this example, the ascent/descent mechanism 90 has, in addition to the configuration for ascending and descending the stacking bottom plate 31 in the first exemplary embodiment, plural suspending portions 405, plural wires 406, and plural guide pulleys 407 all for ascending and descending the additional stacking portion 403. The wires 406 suspend and support the additional stacking portion 403. After the wires 406 are looped over the respective guide pulleys 96 that are existing constituents of the ascent/descent mechanism 90 in the body portion 300 area, one end side of each of the wires 406 is anchored to a corresponding one of the winding pulleys 97 that are existing constituents. The ascent/descent mechanism 90 causes the additional stacking portion 403 and the specialized stacking portion 422 to ascend and descend at the same timing by the driving motor 98, which is an existing constituent, rotating.

Furthermore, inside the external housing 402 of the addition section 401, around the additional stacking portion 403, additional side guides 432 (specifically, 432*a* and 432*b*) that guide long media for positioning both sides of the long media in the width direction intersecting the delivery direction of the long media are provided. In addition, the existing end guide 33 is also used here as an end guide for the additional stacking portion 403. Moreover, in the additional side guides 432, an additional fluffing mechanism 440 is provided, and additional medium regulating portions 450 for preventing side edge portions of a long medium from being excessively fluffed when the long media are fluffed are disposed. In FIG. 22, reference 441 denotes air blowing ports of the additional fluffing mechanisms 440, and each of the additional medium regulating portions 450 is provided near the corresponding air blowing port 441.

Regarding the medium feeding device 11 in which the long size option 400 is used, long media are stored in the long medium stacking portion 410, a surface of the long media is located at a predetermined position by using the ascent/descent mechanism 90, and the medium feeding device 11 is held on standby in such a state until a medium feeding instruction is provided.

When the medium feeding instruction is provided, the medium feeding operation is performed. During the medium feeding operation, the fluffing mechanism 70 and the additional fluffing mechanism 440 operate and fluff the long media, and the vacuum head 50 sticks by suction to an upper surface portion on the downstream side, in the delivery direction, of a fluffed long medium and transports the long medium to the delivery roller 40. In addition, the air separation mechanism 80 separates a downstream end portion, in the delivery direction, of the long media one after another, and the long media are transferred to the delivery roller 40 individually.

At this time, the long media tend to be easily skewed compared with normal-size media. In this example, a state of a downstream end portion, in the delivery direction, of a long medium is detected, and whether the feeding state of the long medium is in the permissible range or in the abnormal range may be determined.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium feeding device comprising:

a storage unit that stores media in a form of a sheet;

a delivery unit that is disposed downstream in a medium delivery direction relative to the media stored in the storage unit and that delivers the media individually;

a transfer unit that is disposed above the storage unit and that sticks by suction to each of the media stored in the storage unit and transfers the media to the delivery unit individually;

a fluffing unit that is disposed beside the media stored in the storage unit in a direction intersecting the medium delivery direction, the fluffing unit fluffing an upper-side region of the media in a state of being separated by blowing air toward a side of the media; and a plurality of position detection units that are in a region that is on a delivery unit side relative to a position of a downstream end portion, in the medium delivery direction, of each of the media stored in the storage unit and that does not reach a contact portion where the delivery unit comes into contact with the media, the position detection units being arranged at an interval in a width direction of the media intersecting the medium delivery direction, the position detection units detecting a position of the downstream end portion, in the medium delivery direction, of each of the media, wherein the position detection units are closer to the downstream end portion, in the medium delivery direction, of the media stored in the storage unit than to the contact portion of the delivery unit with the media, and the position detection units are closer, in a direction intersecting the medium delivery direction, to an outside end portion of the media stored in the storage unit than a stopper wall is to the outside end portion of the media stored in the storage unit.

2. A medium feeding device comprising:

a storage unit that stores media in a form of a sheet;

a delivery unit that is disposed downstream in a medium delivery direction relative to the media stored in the storage unit and that delivers the media individually;

a transfer unit that is disposed above the storage unit and that sticks by suction to each of the media stored in the storage unit and transfers the media to the delivery unit individually;

a fluffing unit that is disposed beside the media stored in the storage unit in a direction intersecting the medium delivery direction, the fluffing unit fluffing an upper-side region of the media in a state of being separated by blowing air toward a side of the media; and a plurality of position detection units that are arranged in a region that is on a delivery unit side relative to a position of a downstream end portion, in the medium delivery direction, of each of the media stored in the storage unit and that does not reach a contact portion where the delivery unit comes into contact with the media, the position detection units being arranged at an interval in a width direction of the media intersecting the medium delivery direction, the position detection units detecting a position of the downstream end portion, in the medium delivery direction, of each of the media; and a control unit that determines whether a state of a downstream end portion, in the medium delivery direction, of a medium is within a predetermined permissible range, based on information detected by the position detection units, and that stops a feeding operation of the medium when the state of the downstream end portion of the medium in the medium delivery direction is in an abnormal range that is out of the permissible range.

3. The medium feeding device according to claim 2, wherein the position detection units are arranged closer to the downstream end portion, in the medium delivery direction, of the media stored in the storage unit than to the contact portion of the delivery unit with the media.

4. The medium feeding device according to claim 1, wherein the storage unit has, on the delivery unit side, the stopper wall, which is capable of retaining the media stored in the storage unit when the fluffing unit is not used, and wherein the position detection units are closer to the stopper wall than to the contact portion of the delivery unit with the media.

5. The medium feeding device according to claim 3, wherein the storage unit has, on the delivery unit side, a stopper wall capable of retaining the media stored in the storage unit when the fluffing unit is not used, and wherein the position detection units are arranged closer to the stopper wall than to the contact portion of the delivery unit with the media.

6. The medium feeding device according to claim 1, wherein the delivery unit is held by a holding frame having attachment portions, and wherein the position detection units are attached to the respective attachment portions.

7. The medium feeding device according to claim 3, wherein the delivery unit is held by a holding frame having attachment portions, and wherein the position detection units are attached to the respective attachment portions.

8. The medium feeding device according to claim 1, wherein the position detection units are, in the width direction of the media, on outer sides of the contact portion of the delivery unit with the media.

9. The medium feeding device according to claim 3, wherein the position detection units are, in the width direction of the media, on outer sides of the contact portion of the delivery unit with the media.

10. The medium feeding device according to claim 2, wherein the control unit grasps a skew state of the downstream end portion of the medium in the medium delivery direction, based on information received from the position detection units, and determines whether the skew state is within the permissible range.

11. The medium feeding device according to claim 10, wherein the control unit also addresses a case in which the position detection units do not detect a presence of the medium within a predetermined time period as a case included in the abnormal range.

12. The medium feeding device according to claim 2, further comprising:

an alert unit that issues an alert to a user, wherein the control unit provides a notification to the alert unit when determining that the state of the downstream end portion of the medium in the medium delivery direction is in the abnormal range.

13. The medium feeding device according to claim 10, further comprising:

an alert unit that issues an alert to a user, wherein the control unit provides a notification to the alert unit when determining that the state of the downstream end portion of the medium in the medium delivery direction is in the abnormal range.

14. The medium feeding device according to claim 2, wherein, following a determination that the state of the downstream end portion of the medium in the medium delivery direction is in the abnormal range, when the control unit stops the feeding operation of the medium with the downstream end portion of the medium in the medium delivery direction not being in contact with the delivery unit, the control unit returns the medium to an original position with the transfer unit sticking to the medium by suction and causes the transfer unit to stop a transfer operation.

15. The medium feeding device according to claim 10, wherein, following a determination that the state of the downstream end portion of the medium in the medium delivery direction is in the abnormal range, when the control unit stops the feeding operation of the medium with the downstream end portion of the medium in the medium delivery direction not being in contact with the delivery unit, the control unit returns the medium to an original position with the transfer unit sticking to the medium by suction and causes the transfer unit to stop a transfer operation.

16. The medium feeding device according to claim 2, wherein, following a determination that the state of the downstream end portion of the medium in the medium delivery direction is in the abnormal range, when the control unit stops the feeding operation of the medium with the downstream end portion of the medium in the medium delivery direction being in contact with the delivery unit, the control unit causes the delivery unit to stop after completing a delivery operation by the delivery unit.

17. The medium feeding device according to claim 10, wherein, following a determination that the state of the downstream end portion of the medium in the medium delivery direction is in the abnormal range, when the control unit stops the feeding operation of the medium with the downstream end portion of the medium in the medium delivery direction being in contact with the delivery unit, the control unit causes the delivery unit to stop after completing a delivery operation by the delivery unit.

18. A medium processing apparatus comprising:

the medium feeding device according to claim 1; and a processing unit that performs predetermined processing on media fed from the medium feeding device.

19. A medium feeding device comprising:

a storage unit that stores media in a form of a sheet;

a delivery unit that is disposed downstream in a medium delivery direction relative to the media stored in the storage unit and that delivers the media individually;

a transfer unit that is disposed above the storage unit and that sticks by suction to each of the media stored in the storage unit and transfers the media to the delivery unit individually;

a fluffing unit that is disposed beside the media stored in the storage unit in a direction intersecting the medium delivery direction, the fluffing unit fluffing an upper-side region of the media in a state of being separated by blowing air toward a side of the media; and a plurality of position detection units that are in a region that is on a delivery unit side relative to a position of a downstream end portion, in the medium delivery direction, of each of the media stored in the storage unit and that does not reach a contact portion where the delivery unit comes into contact with the media, the position detection units being arranged at an interval in a width direction of the media intersecting the medium delivery direction, the position detection units detecting a position of the downstream end portion, in the medium delivery direction, of each of the media, wherein the position detection units are closer, in the medium delivery direction, to the downstream end portion of the media stored in the storage unit than to the contact portion of the delivery unit with the media, the delivery unit is held by a holding frame having attachment portions, and the position detection units are attached to the respective attachment portions.

* * * * *